US009746795B2

(12) United States Patent
Kawanabe et al.

(10) Patent No.: US 9,746,795 B2
(45) Date of Patent: Aug. 29, 2017

(54) OPTICAL WRITING CONTROL DEVICE, IMAGE FORMING APPARATUS, AND OPTICAL WRITING CONTROL METHOD FOR CONTROLLING LIGHT EMISSION OF A LIGHT SOURCE

(71) Applicants: Motohiro Kawanabe, Osaka (JP); Yoshinori Shirasaki, Osaka (JP); Masayuki Hayashi, Osaka (JP); Masatoshi Murakami, Osaka (JP); Yuusuke Kohri, Osaka (JP); Akinori Yamaguchi, Osaka (JP)

(72) Inventors: Motohiro Kawanabe, Osaka (JP); Yoshinori Shirasaki, Osaka (JP); Masayuki Hayashi, Osaka (JP); Masatoshi Murakami, Osaka (JP); Yuusuke Kohri, Osaka (JP); Akinori Yamaguchi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/064,958

(22) Filed: Mar. 9, 2016

(65) Prior Publication Data

US 2016/0274481 A1 Sep. 22, 2016

(30) Foreign Application Priority Data

Mar. 16, 2015 (JP) ..... 2015-052463
Dec. 9, 2015 (JP) ..... 2015-240334

(51) Int. Cl.

| | |
|---|---|
| ***G03G 15/04*** | (2006.01) |
| ***G03G 15/043*** | (2006.01) |
| ***G03G 21/08*** | (2006.01) |

(52) U.S. Cl.
CPC ..... *G03G 15/043* (2013.01); *G03G 15/04054* (2013.01); *G03G 21/08* (2013.01)

(58) Field of Classification Search
CPC ..... G03G 15/043
USPC ..... 399/4, 51; 347/224
See application file for complete search history.

(56) References Cited

U.S. PATENT DOCUMENTS

| | | | |
|---|---|---|---|
| 2012/0300010 A1 | 11/2012 | Kawanabe et al. | |
| 2014/0139607 A1 | 5/2014 | Hayashi et al. | |
| 2014/0153042 A1 | 6/2014 | Kawanabe et al. | |
| 2015/0261121 A1 | 9/2015 | Kawanabe et al. | |
| 2016/0179029 A1* | 6/2016 | Shibuya | G03G 15/043 399/51 |

FOREIGN PATENT DOCUMENTS

| | | |
|---|---|---|
| JP | 2009-175631 | 8/2009 |
| JP | 2011-064832 | 3/2011 |
| JP | 2012-045773 | 3/2012 |
| JP | 2012-200144 | 10/2012 |
| JP | 2012-244589 | 12/2012 |

(Continued)

*Primary Examiner* — Quana M Grainger
(74) *Attorney, Agent, or Firm* — Oblon, McClelland, Maier & Neustadt, L.L.P.

(57) ABSTRACT

An optical writing control device controls emission or lighting of a light source onto a photoconductor surface in a latent image forming process and a discharge process, by either setting a light emission time longer in the discharge process or setting a resolution in a sub-scanning direction lower in the discharge process, compared to the latent image forming process.

10 Claims, 20 Drawing Sheets

(56) References Cited

FOREIGN PATENT DOCUMENTS

| | | |
|---|---|---|
| JP | 2013-109295 | 6/2013 |
| JP | 2014-008743 | 1/2014 |
| JP | 2014-043079 | 3/2014 |
| JP | 2014-044299 | 3/2014 |
| JP | 2014-110528 | 6/2014 |

* cited by examiner

FIG. 16
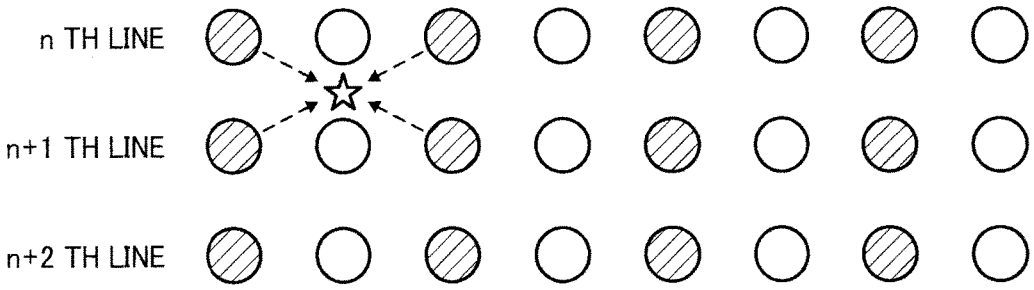
FIG. 17
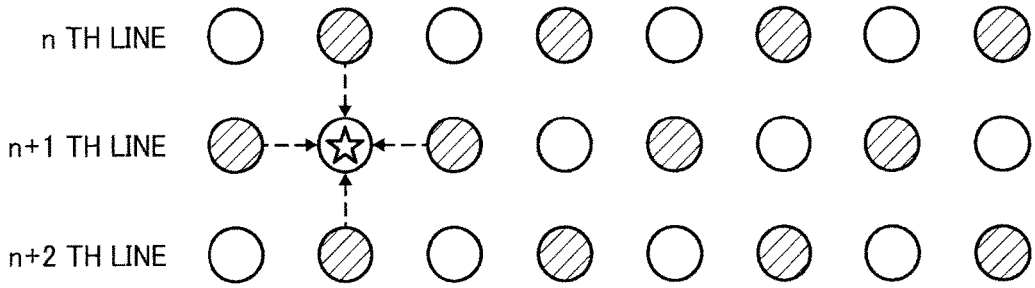
FIG. 18
| DISTANCE BETWEEN LED ELEMENTS | EXPOSURE ENERGY |
|---|---|
| 0 | 100% |
| 1 | 40% |
| $(5^{1/2})/2$ | 25% |

FIG. 21
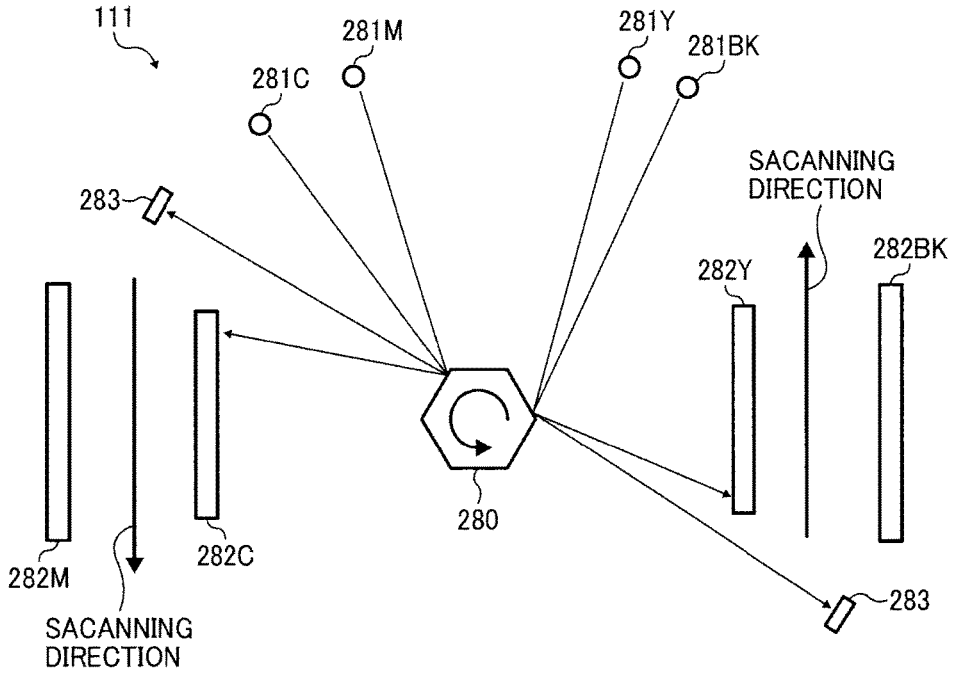
FIG. 22
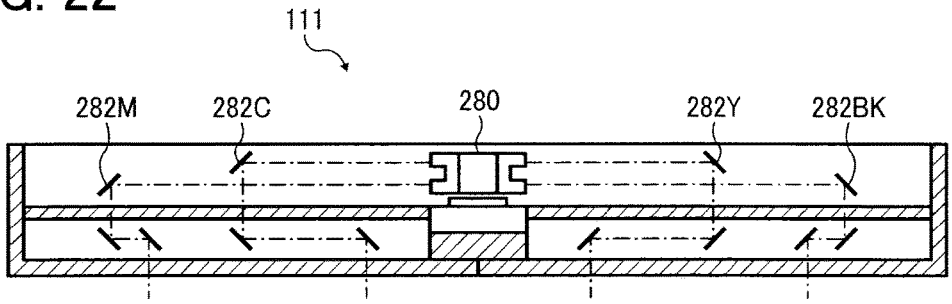
FIG. 23
| | | | | | |
|---|---|---|---|---|---|
| | | | | DIS-CHARGING | |
| OPERATING STATE | STAND-BY | PRINTING FIRST PAGE | PRINTING SECOND PAGE | | STAND-BY |
| ROTATING STATE | STOP | ROTATING | | | STOP |

OPTICAL WRITING CONTROL DEVICE, IMAGE FORMING APPARATUS, AND OPTICAL WRITING CONTROL METHOD FOR CONTROLLING LIGHT EMISSION OF A LIGHT SOURCE

CROSS-REFERENCE TO RELATED APPLICATIONS

This patent application is based on and claims priority pursuant to 35 U.S.C. §119(a) to Japanese Patent Application Nos. 2015-052463, filed on Mar. 16, 2015, and 2015-240334, filed on Dec. 9, 2015, in the Japan Patent Office, the entire disclosure of which is hereby incorporated by reference herein.

BACKGROUND

Technical Field

The present invention relates to an optical writing control device, an image forming apparatus, and an optical writing control method.

Description of the Related Art

In recent years, the computerization of information tends to be promoted. Thus, image processing apparatuses such as a printer and a facsimile that are used for outputting the computerized information, and a scanner that is used for computerizing documents have become indispensable apparatuses. Among such image processing apparatuses, an electrophotographic image forming apparatus is widely used as an image forming apparatus used for outputting the computerized documents.

The electrophotographic image forming apparatus performs image formation and image output in the following manner. First, an electrostatic latent image is formed by exposing a photoconductor. Then, the formed electrostatic latent image is developed using developer such as toner, so that a toner image is formed. The toner image is transferred onto a sheet, and the sheet is output.

In such an electrophotographic image forming apparatus, after the toner image developed on the photoconductor is transferred, discharge exposure of exposing the entire surface for eliminating electric charge remaining on the photoconductor is performed. A dedicated light source is provided for this discharge exposure in some cases. In other cases, a light source for forming an electrostatic latent image is also used for the discharge exposure.

On the other hand, in some cases, a linear light source is used as a light source for exposing the photoconductor. In the linear light source, point light sources such as light emitting diode (LED) elements or electro-luminescence (EL) elements are linearly arrayed in a main scanning direction. When the LED elements are arrayed, the linear light source is referred to as an LED Array (LEDA).

SUMMARY

In one aspect of the invention, an optical writing control device includes a light source controller to control emission of a light source onto a photoconductor surface in a latent image forming process and a discharge process, the light source including a plurality of linearly-arranged light emission elements. In the latent image forming process, the light source controller causes the light source to emit the light based on image data input to the light source controller to form an electrostatic latent image on the photoconductor surface. In the discharge process, the light source controller causes the light source to emit the light while turning off a part of the plurality of light emission elements to discharge the photoconductor surface. A light emission time of one light emission control in the discharge process is set longer than a light emission time of one light emission control in the latent image forming process.

In another aspect of the invention, an optical writing control device includes a light source controller to control lighting of a light source onto a photoconductor surface in latent image forming process and a discharge process. In the latent image forming process, the light source controller causes the light source to emit the light based on image data input to the light source controller to form an electrostatic latent image on the photoconductor surface. In the discharge process, the light source controller causes the light source to emit the light to discharge the photoconductor surface. A resolution in a sub-scanning direction in the discharge process is set lower than a resolution in a sub-scanning direction in the latent image forming process.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein:

FIG. 16 is a diagram illustrating states of surrounding LED elements that contribute to an exposure energy at a position farthest from LED elements driven to emit light according to the embodiment of the present invention;

FIG. 17 is a diagram illustrating states of surrounding LED elements that contribute to an exposure energy at a position farthest from LED elements driven to emit light according to the embodiment of the present invention;

FIG. 18 is a diagram illustrating a percentage of an exposure energy corresponding to a distance from a light emission element according to the embodiment of the present invention;

FIG. 21 is a top view illustrating a configuration of an optical writing device according to an embodiment of the present invention;

FIG. 22 is a sectional side view illustrating a configuration of the optical writing device of FIG. 21;

FIG. 23 is a diagram illustrating an operating state of the entire apparatus and a rotating state of a photoconductor of FIG. 21;

Figure 1:
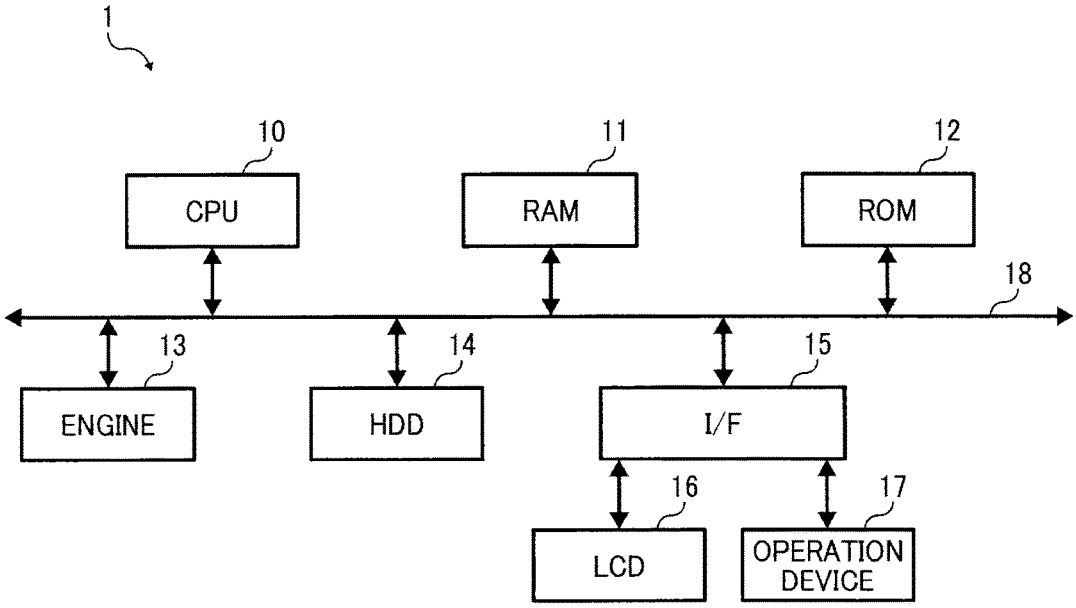
FIG. 1 is a block diagram illustrating a hardware configuration of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring to the drawings, embodiments of the present invention will be described in detail below using examples.

First Embodiment

In a first embodiment, an image forming apparatus serving as a multifunction peripheral (MFP) will be described. The image forming apparatus is an electrophotographic image forming apparatus, which includes a light source for exposing a photoconductor. More specifically, a linear light source in which light emission elements are arrayed in a main scanning direction is used as the light source.

The above-described linear light source is also used in the exposure for eliminating electric charge remaining on the photoconductor from which a toner image has been transferred. As described below, the instantaneous consumed amount of current during a discharge process by the linear light source is reduced, through thinning out light emission elements to be driven to emit light. In order to compensate for the reduction in exposure energy that is incidental to the thinning out, a strobe period, i.e., a light emission time in one light emission control is extended.

FIG. 1 is a block diagram illustrating a hardware configuration of an image forming apparatus 1 according to this embodiment. As illustrated in FIG. 1, the image forming apparatus 1 includes an engine for executing image formation, in addition to a configuration similar to that of an information processing terminal such as a general server and a personal computer (PC). More specifically, the image forming apparatus 1 includes a central processing unit (CPU) 10, a random access memory (RAM) 11, a read only memory (ROM) 12, an engine 13, a hard disk drive (HDD) 14, and an interface (I/F) 15, which are connected to one another via a bus 18. In addition, a liquid crystal display (LCD) 16 and an operation device 17 are connected to the I/F 15.

The CPU 10 is a processor, which controls entire operation of the image forming apparatus 1. The RAM 11 is a volatile recording medium capable of reading or writing at high speed, and used as a work area for the CPU 10. The ROM 12 is a read-only non-volatile recording medium, and stores programs such as firmware. The engine 13 executes image formation.

The HDD 14 is a non-volatile recording medium capable of reading or writing various data, and stores an operating system (OS), various control programs, an application program, and the like. The I/F 15 connects the bus 18 to hardware, networks, and the like, to perform control in data transmission or reception. The LCD 16 operates as a visual user interface for allowing a user to check the state of the image forming apparatus 1. The operation device 17 operates as a user interface for allowing a user to input information to the image forming apparatus 1, and includes a touch panel, various hardware keys, and the like that may be provided on a screen displayed by the LCD 16.

The CPU 10 performs calculation according to a program stored in the ROM 12, or a program loaded into the RAM 11 from a recording medium such as the HDD 14 or an optical disc, to cooperate with hardware to achieve various functions as described below according to this embodiment.

Figure 2:
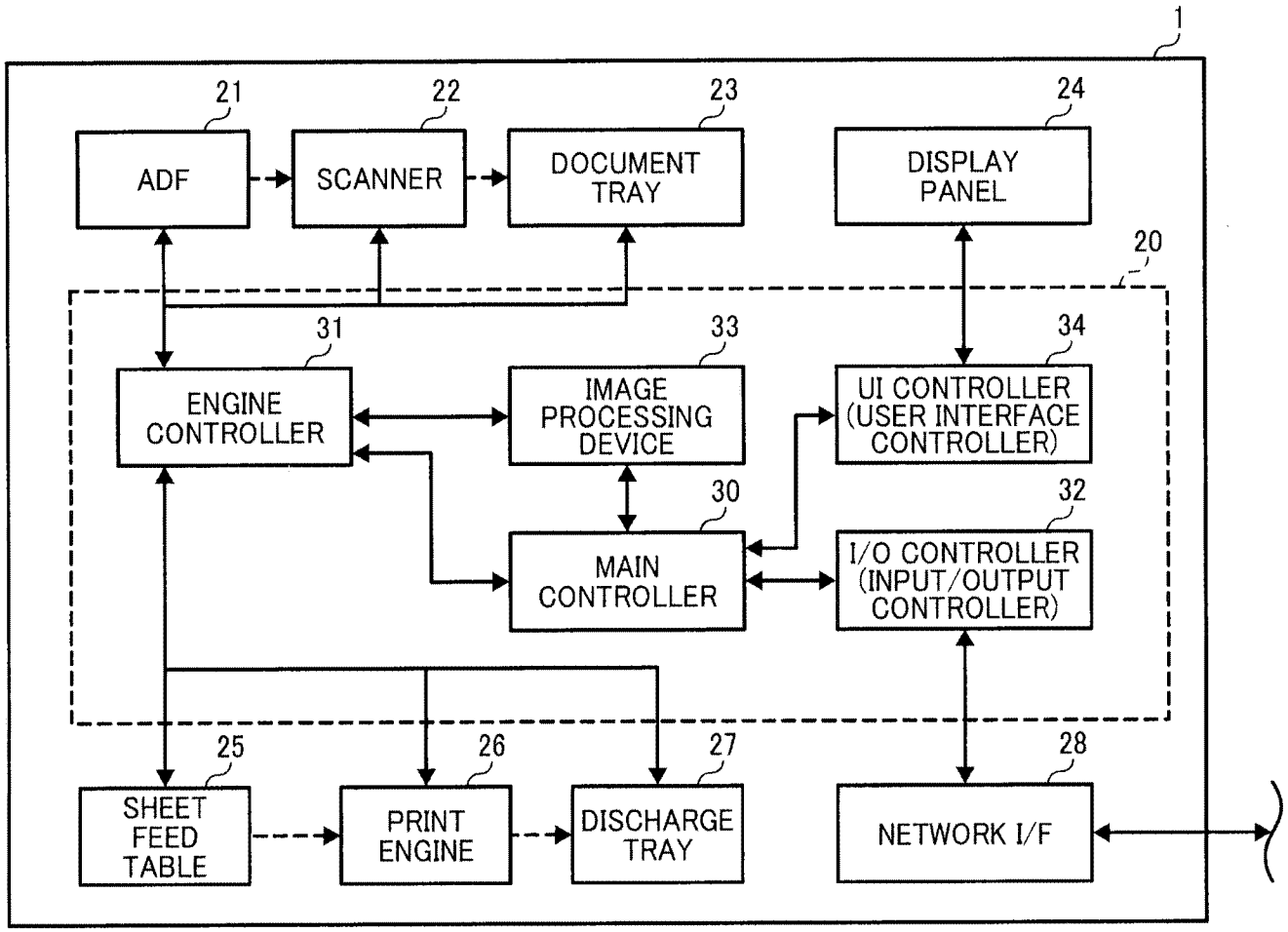
FIG. 2 is a diagram illustrating a functional configuration of a control section of the image forming apparatus of FIG. 1.

Next, a functional configuration of a control section of the image forming apparatus 1 according to this embodiment will be described with reference to FIG. 2. FIG. 2 is a diagram illustrating a functional configuration of the image forming apparatus 1, together with a part of hardware of the image forming apparatus 1. As illustrated in FIG. 2, the image forming apparatus 1 includes a controller 20, an auto document feeder (ADF) 21, a scanner 22, a document tray 23, a display panel 24, a sheet feed table 25, a print engine 26, a discharge tray 27, and a network I/F 28. The controller 20 has a hardware configuration as described above referring to FIG. 1.

The controller 20 includes a main controller 30, an engine controller 31, an input/output (I/O) controller 32, an image processing device 33, and a user interface (UI) controller 34. As illustrated in FIG. 2, the image forming apparatus 1 is implemented by a multifunction peripheral including the scanner 22 and the print engine 26. In addition, in FIG. 2, solid line arrows indicate electrical connection, and broken line arrows indicate flows of a sheet.

The display panel 24 serves as an output interface for visually displaying the state of the image forming apparatus 1 (LCD 16), and also serves as an input interface (operation device 17) for the user directly operating the image forming apparatus 1 or inputting information to the image forming apparatus 1, as a touch panel. Thus, the display panel 24 corresponds to the LCD 16 and the operation device 17 in FIG. 1. The network I/F 28 is an interface for the image forming apparatus 1 communicating with another device via a network, and the Ethernet (registered trademark) or a universal serial bus (USB) interface is used.

The controller 20 corresponds to instructions of the CPU 10, which are generated according to a program stored in a memory. The controller 20 functions as a controller for controlling the entire image forming apparatus 1.

The main controller 30 has a function of controlling the components included in the controller 20, and issues a command to the components in the controller 20. The engine controller 31 functions as a driver for controlling or driving the print engine 26, the scanner 22, and the like. The I/O controller 32 inputs signals and commands that are input via the network I/F 28, to the main controller 30. In addition, the main controller 30 controls the I/O controller 32, and accesses another device via the network I/F 28.

According to the control of the main controller 30, the image processing device 33 generates rendering information based on print information included in an input print job. The rendering information refers to information for rendering an image to be formed by the print engine 26 in an image forming operation. In addition, the print information included in the print job refers to image information that has been converted by a printer driver installed on an information processing apparatus such as a PC, into a format recognizable by the image forming apparatus 1. The UI controller 34 displays information on the display panel 24 or notifies the main controller 30 of information input via the display panel 24.

When the image forming apparatus 1 operates as a printer, first, the I/O controller 32 receives a print job via the network I/F 28. The I/O controller 32 transfers the received print job to the main controller 30. Upon receiving the print job, the main controller 30 controls the image processing device 33 to generate rendering information based on print information included in the print job.

When the rendering information is generated by the image processing device 33, the engine controller 31 controls the print engine 26 based on the generated rendering information to form an image on a sheet conveyed from the sheet feed table 25. In other words, the print engine 26 functions as an image forming unit. A document on which an image is formed by the print engine 26 is discharged onto the discharge tray 27.

When the image forming apparatus 1 operates as a scanner, the UI controller 34 or the I/O controller 32 transfers a scanning execution signal to the main controller 30 in response to an operation of the display panel 24 that is performed by the user, or a scanning execution instruction input via the network I/F 28 from an external PC or the like. The main controller 30 controls the engine controller 31 based on the received scanning execution signal.

The engine controller 31 drives the ADF 21 to convey an image capturing target document set on the ADF 21, to the scanner 22. In addition, the engine controller 31 drives the scanner 22 to capture an image of the document conveyed from the ADF 21. In addition, when the document is not set on the ADF 21 but directly set on the scanner 22, the scanner 22 captures an image of the set document according to the control of the engine controller 31. In other words, the scanner 22 operates as an image capturing unit.

In an image capturing operation, an image sensor such as a charge-coupled device (CCD) sensor that is included in the scanner 22 optically scans a document, so that image capturing information is generated based on optical information. The engine controller 31 transfers the image capturing information generated by the scanner 22, to the image processing device 33. According to the control of the main controller 30, the image processing device 33 generates image information based on the image capturing information received from the engine controller 31. The image information generated by the image processing device 33 is stored into a storage medium such as the HDD 14 that is loaded on the image forming apparatus 1. In other words, the scanner 22, the engine controller 31, and the image processing device 33 function as a document reader in conjunction with one another.

In response to an instruction from the user, the image information generated by the image processing device 33 is directly stored into the HDD 14 or the like, or transmitted to an external apparatus via the I/O controller 32 and the network OF 28. In other words, the ADF 21 and the engine controller 31 function as an image input unit.

In addition, when the image forming apparatus 1 operates as a copying machine, the image processing device 33 generates rendering information based on image capturing information that has been received by the engine controller 31 from the scanner 22 or image information generated by the image processing device 33. Similarly to the case of operating as a printer, the engine controller 31 drives the print engine 26 based on the generated rendering information.

Figure 3:
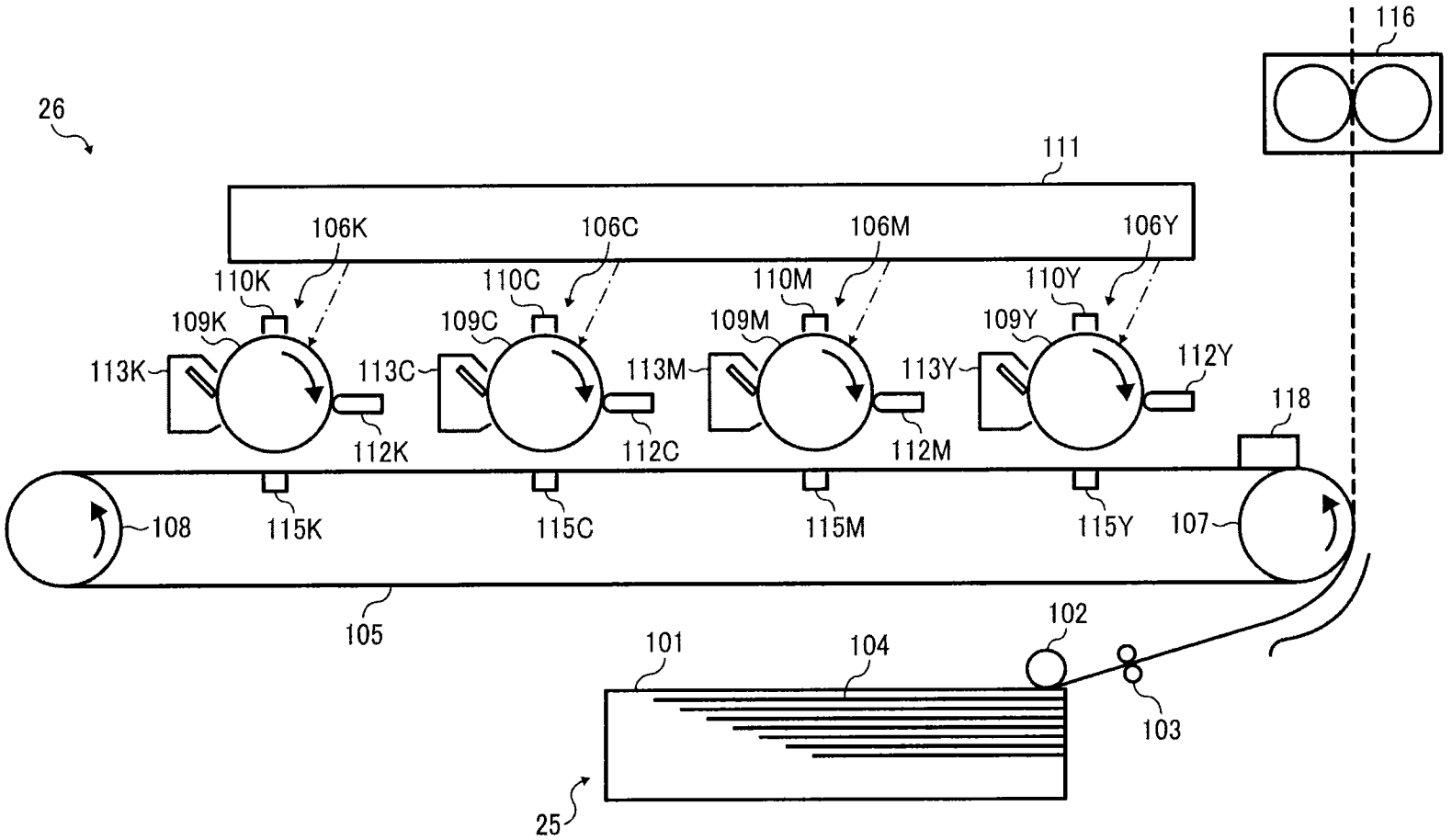
FIG. 3 is a diagram illustrating a configuration of a print engine of the image forming apparatus of FIG. 1.

Next, the configuration of the print engine 26 will be described with reference to FIG. 3. As illustrated in FIG. 3, the print engine 26 includes image forming units 106 of respective colors that are arranged along a conveyance belt 105 serving as an endless moving device. The print engine 26 is of a so-called tandem type. More specifically, a plurality of image forming units (electrophotographic processors) 106Y, 106M, 106C, and 106K (hereinafter, collectively referred to as an image forming unit 106) is arrayed along the conveyance belt 105 in order from an upstream side in a conveyance direction of the conveyance belt 105. The conveyance belt 105 serves as an intermediate transfer belt on which an intermediate transfer image is formed. The intermediate transfer image is formed to be transferred onto a sheet (an example of a recording medium) 104 that has been separated and fed by a sheet feeding roller 102 from a sheet feeding tray 101.

In addition, the sheet 104 fed from the sheet feeding tray 101 is once stopped by a registration roller 103, and fed to a position where an image is to be transferred from the conveyance belt 105, according to an image forming timing of the image forming unit 106.

The plurality of image forming units 106Y, 106M, 106C, and 106K has a common internal configuration although the colors of formed toner images are different from one another. The image forming unit 106K forms a black image, the image forming unit 106M forms a magenta image, the image forming unit 106C forms a cyan image, and the image forming unit 106Y forms a yellow image. In addition, in the following description, the image forming unit 106Y will be specifically described. The other image forming units 106M, 106C, and 106K are similar to the image forming unit 106Y. Thus, the components of the image forming unit 106M, 106C, or 106K are only illustrated in FIG. 3 with signs discriminated by "M", "C", or "K", in place of "Y" allocated to the components of the image forming unit 106Y, and the descriptions thereof will be omitted.

The conveyance belt 105 is an endless belt stretched around a driving roller 107 that is to be rotationally driven and a driven roller 108. The driving roller 107 is rotationally driven by a drive motor. The drive motor, the driving roller 107, and the driven roller 108 function as a driver for moving the conveyance belt 105 serving as an endless moving device.

During image formation, the first image forming unit 106Y transfers a yellow toner image onto the rotationally-driven conveyance belt 105. The image forming unit 106Y includes, for example, a photoconductor drum 109Y serving as a photoconductor, and a charging device 110Y, an optical writing device 111, a developing device 112Y, a photoconductor cleaner 113Y that are arranged around the photoconductor drum 109Y. The optical writing device 111 irradiates the photoconductor drums 109Y, 109M, 109C, and 109K (hereinafter, collectively referred to as a "photoconductor drum 109") with light.

In image formation, the outer circumferential surface of the photoconductor drum 109Y is uniformly charged by the charging device 110Y in the dark, and then, writing is performed using light from the optical writing device 111 that is emitted from a light source corresponding to a yellow image, so that an electrostatic latent image is formed. The developing device 112Y visualizes the electrostatic latent image as a visible image, using yellow toner. Through the process, a yellow toner image is formed on the photoconductor drum 109Y.

This toner image is transferred onto the conveyance belt 105 by the function of a transfer device 115Y, at a position where the photoconductor drum 109Y and the conveyance belt 105 come into contact with each other or come closest to each other (transfer position). Through the transfer, a yellow toner image is formed on the conveyance belt 105. When the toner image transfer is completed, unnecessary toner remaining on the outer circumferential surface of the photoconductor drum 109Y is swept away by the photoconductor cleaner 113Y, and then, the photoconductor drum 109Y stands by for next image formation.

The yellow toner image that has been transferred onto the conveyance belt 105 by the image forming unit 106Y in the above-described manner is conveyed to the next image forming unit 106M by the roller driving of the conveyance belt 105. In the image forming unit 106M, a magenta toner image is fainted on the photoconductor drum 109M through a process similar to an image forming process in the image forming unit 106Y. Then, the magenta toner image is transferred to be superimposed onto the already-formed yellow image.

The yellow and magenta toner images transferred onto the conveyance belt 105 are further conveyed to the next image forming units 106C and 106K. Through similar operations, a cyan toner image formed on the photoconductor drum 109C and a black toner image formed on the photoconductor drum 109K are transferred to be superimposed onto the already-transferred images. In this manner, a full color intermediate transfer image is formed on the conveyance belt 105.

The sheets 104 stored in the sheet feeding tray 101 are sequentially fed from the uppermost sheet 104, and the intermediate transfer image formed on the conveyance belt 105 is transferred onto the surface of the fed sheet 104 at a position where a conveyance path of the sheet 104 comes into contact with or comes closest to the conveyance belt 105. Through the process, an image is formed on the surface of the sheet 104. The sheet 104 having the image formed on its surface is further conveyed, and the image is fixed by a fixing device 116. Then, the sheet 104 is discharged to the outside of the image forming apparatus 1.

In addition, a belt cleaner 118 is provided for removing toner remaining on the conveyance belt 105 without being transferred onto the sheet 104. As illustrated in FIG. 3, the belt cleaner 118 is a cleaning blade pressed against the conveyance belt 105 on a downstream side of the driving roller 107 and on an upstream side of the photoconductor drums 109. The belt cleaner 118 serves as a developer remover for scraping off toner adhering to the surface of the conveyance belt 105.

When one print job is completed in this manner, the optical writing device 111 performs a discharge process. In the discharge process, the optical writing device 111 exposes the entire surfaces of the photoconductor drums 109 of the respective colors to eliminate electric charge remaining on the surfaces of the photoconductor drums 109 from which the toner images have been transferred.

In addition, an intermediate transfer method of transferring the images formed on the conveyance belt 105, onto the sheet 104 has been described as an example with reference to FIG. 3. Alternatively, a direct transfer method is also applicable in a similar manner. In the direct transfer method, the images are directly transferred onto the sheet 104 from the respective photoconductor drums 109.

Figure 4:
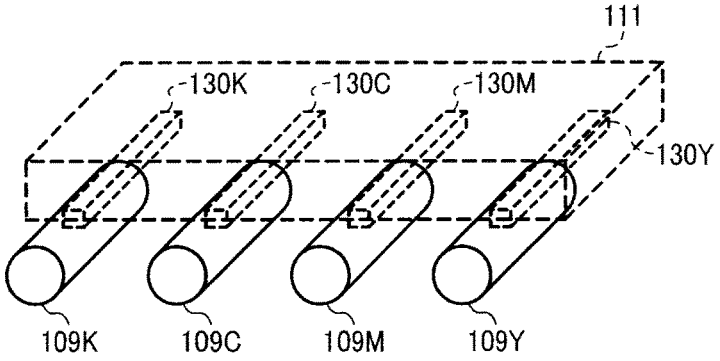
FIG. 4 is a diagram illustrating a configuration of an optical writing device of the image forming apparatus of FIG. 1.

Next, the optical writing device 111 according to this embodiment will be described. FIG. 4 is a diagram illustrating an arrangement relationship between the optical writing device 111 and the photoconductor drums 109 in the case of using a linear light source in which LED elements are arrayed in the main scanning direction. As illustrated in FIG. 4, irradiation beams are respectively emitted from LEDA print heads 130Y, 130M, 130C, and 130K (hereinafter, collectively referred to as an LEDA print head 130) onto the photoconductor drums 109Y, 109M, 109C, and 109K of the respective colors. The LEDA print head 130 is used as a light source device.

Figure 5:
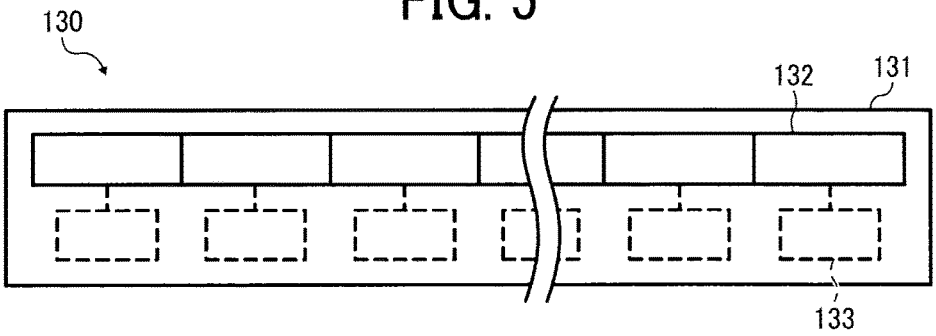
FIG. 5 is a diagram illustrating a configuration of an LEDA print head.

FIG. 5 is a diagram illustrating a configuration of the LEDA print head 130. In FIG. 5, the emission surface of an LEDA serving as a light source included in the LEDA print head 130 is illustrated from the front surface. As illustrated in FIG. 5, the LEDA print head 130 includes a plurality of LEDAs 132 arrayed on a substrate 131. The direction in which the LEDAs 132 are arrayed corresponds to the main scanning direction of the photoconductor drums 109.

Each of the LEDAs 132 serves as a light emission element array including a plurality of LED elements serving as light emission elements that is arrayed in the same direction as the direction in which a corresponding LEDA 132 is arrayed. Each LED element included in each of the LEDAs 132 performs irradiation corresponding to one pixel.

In addition, a plurality of driving circuits 133 for driving the respective LEDAs 132 to emit light is provided within the substrate 131. The driving circuits 133 correspond to the respective LEDAs 132 on a one-to-one basis.

Based on rendering information input from the controller 20, a controller included in the optical writing device 111 controls, for each main scanning line, the lighted lunminated state of each of LEDs arranged in the LEDA print head 130 in the main scanning direction. As a result, the surface of the photoconductor drum 109 is selectively exposed, so that an electrostatic latent image is formed thereon.

As illustrated in FIG. 5, one LEDA print head 130 includes the plurality of LEDAs 132. In this case, when all of the LED elements included in all the LEDAs 132 are simultaneously driven to emit light, the amount of power required at the instant corresponds to the total of the amounts of powers each required for causing all the LED elements included in one LEDA print head 130 to emit light. In particular, in the above-described discharge process, it is required to drive all the LED elements to emit light because the entire surfaces of the photoconductor drums 109 need to be exposed.

In addition, as illustrated in FIG. 4 and the like, the image forming apparatus 1 includes the LEDA print heads 130 of the respective colors of CMYK. It is therefore necessary to drive the LEDA print heads 130 of the respective colors to emit light for exposing the photoconductor drums 109 of the respective colors.

Figure 6:
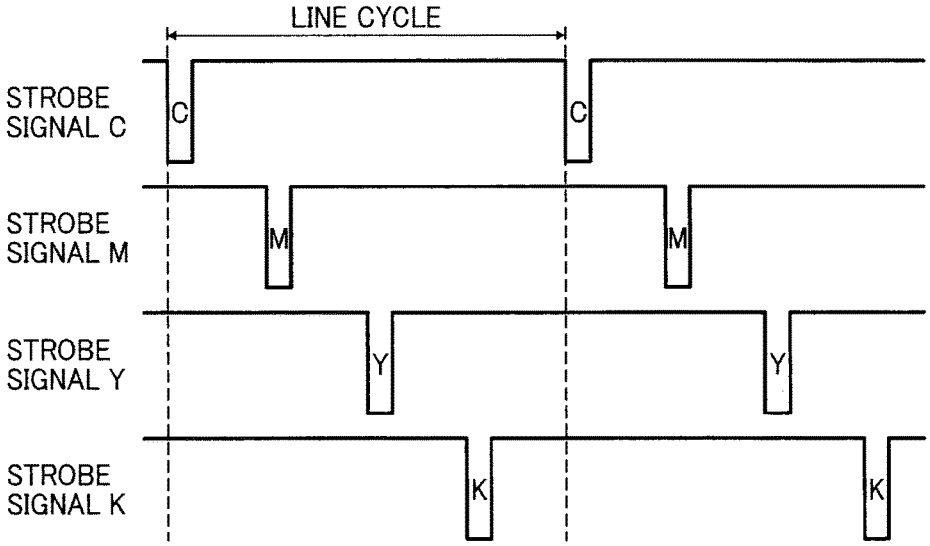
FIG. 6 is a timing chart illustrating a light emission driving timing.

In the process, if light emission driving periods of the LEDA print heads 130 corresponding to different colors overlap with one another, the amount of power required in the overlapped period further increases. Thus, as illustrated in FIG. 6, the optical writing device 111 controls light emission driving timings of the LEDA print heads 130 of the respective colors of CMYK not to overlap with one another in one line cycle.

In such a configuration, the optical writing device 111 controls to reduce the instantaneous consumed amount of current in the above-described discharge process. The control mode in the discharge process will be described below.

Figure 7:
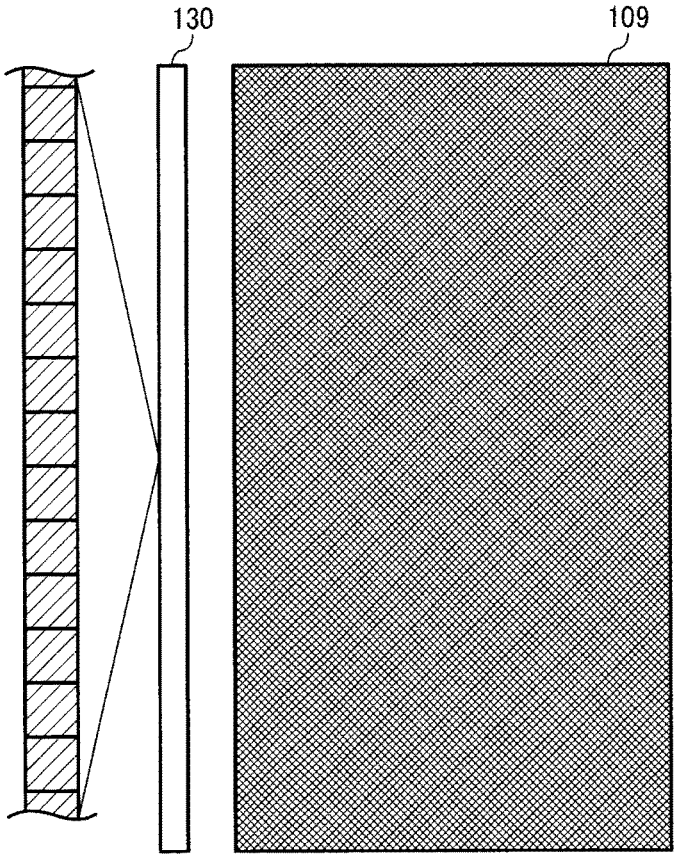
FIG. 7 is a diagram illustrating light emission states of LED elements and an exposure state of a photoconductor drum surface that are obtainable when all LED elements are driven to emit light according to an embodiment of the present invention.

FIG. 7 is a diagram illustrating, by dot density, an exposure energy applied to the surface of the photoconductor drum 109 in a case in which all the LED elements included in the LEDA print head 130 are driven to emit light. In addition, FIG. 8 is a diagram illustrating the intensity of an exposure energy applied by each LED element in the case illustrated in FIG. 7, for each main scanning position, and an exposure energy required for discharging (hereinafter, referred to as "discharge energy"), using a broken line.

Figure 8:
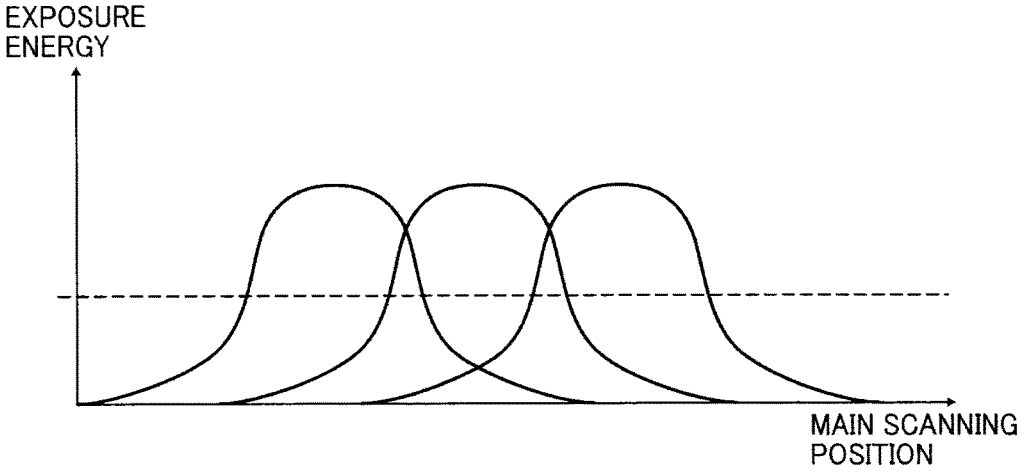
FIG. 8 is a diagram illustrating a state of an exposure energy corresponding to a main scanning position that is obtainable when all LED elements are driven to emit light according to the embodiment of the present invention.

As illustrated in FIG. 8, an exposure energy applied by each LED element has a distribution with a peak at a main scanning position corresponding to the arrangement of a corresponding LED element. In addition, even if the light from each LED shifts in a main scanning direction from the arrangement position of each LED element, before the exposure energy applied by one LED element falls below the discharge energy, the light reaches an arrangement position of an adjacent LED element. Consequently, as illustrated in FIG. 8, exposure energies exceeding the discharge energy are applied to the entire surface of the photoconductor drum 109.

Figure 9:
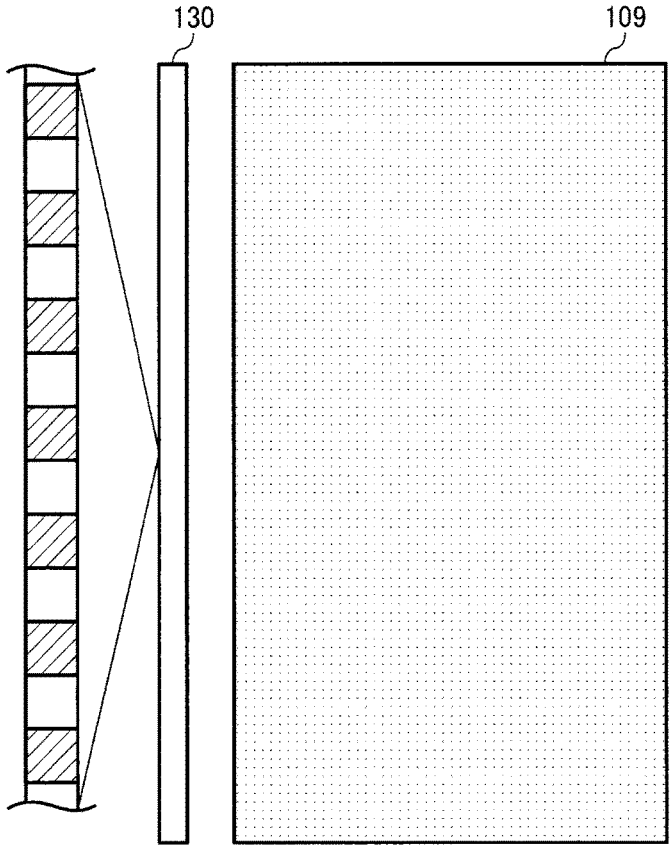
FIG. 9 is a diagram illustrating light emission states of LED elements and an exposure state of a photoconductor drum surface that are obtainable when thinned-out lighting control is performed according to the embodiment of the present invention.

In contrast, FIG. 9 is a diagram illustrating, by dot density, an exposure energy applied to the surface of the photoconductor drum 109 in a case in which the LED elements included in the LEDA print head 130 are alternately driven to emit light. In addition, FIG. 10 is a diagram illustrating the intensity of an exposure energy applied by each LED element in the case illustrated in FIG. 9, for each main scanning position, and an exposure energy required for discharging, using a broken line.

Figure 10:
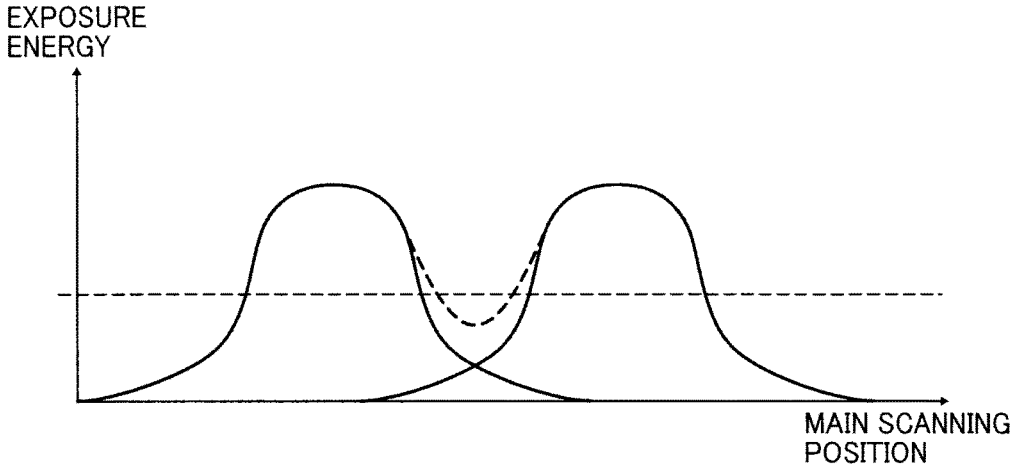
FIG. 10 is a diagram illustrating a state of an exposure energy corresponding to a main scanning position that is obtainable when thinned-out lighting control is performed according to the embodiment of the present invention.

In the case illustrated in FIGS. 9 and 10, the number of LED elements simultaneously driven to emit light becomes a half of that in the case illustrated in FIGS. 7 and 8. Thus, the instantaneous consumed amount of current in the discharge process becomes half. Nevertheless, in the case illustrated in FIG. 10, if a main scanning direction shift occurs from an arrangement position of each LED element, an applied exposure energy falls below the discharge energy before a main scanning position where an exposure energy exceeding the discharge energy is applied by an alternate next LED element driven to emit light is reached.

To cope with such a problem, control called time division driving is performed in some cases. In the time division driving, all the LED elements included in the LEDA print head 130 are divided into a plurality of groups, and light emission driving is performed at timings different for each group in one line cycle. According to the time division driving, the number of LED elements simultaneously turned on corresponds to the number of LED elements included in one group. Thus, the instantaneous consumed amount of current can be reduced.

In the case of the time division driving, however, there is a disadvantage in that, by performing light emission driving at different timings, respective irradiation positions on the photoconductor drum 109 of pixels included in an image corresponding to one line become different for each group. In contrast, in the case of the discharge process, a problem of an irradiation position shift does not occur because it is sufficient that the surface of the photoconductor drum 109 is exposed.

In other words, in the case of the discharge process, only an advantage of reducing the instantaneous consumed amount of current can be obtained without regard to the disadvantage in the time division driving. It is therefore considered that the control of concurrently turning on LED elements corresponding to one line is performed during the exposure for image formation output, and the time division driving is employed during the discharge process.

Nevertheless, in the case of employing a method of switching a light emission driving mode between the image formation output and the discharge process, the configuration for controlling the LEDA print head 130 is complicated in the optical writing device 111. Thus, in this embodiment, a method for reducing the instantaneous consumed amount of current without using the time division driving will be described.

Consequently, as illustrated in FIG. 9, exposure energies applied to the entire surface of the photoconductor drum 109 become smaller than those in the case illustrated in FIG. 7. This generates a region to which an exposure energy exceeding the discharge energy is not applied.

To avoid such a problem, the optical writing device 111 extends a strobe period during which each LED element is driven to emit light in the discharge process. A basic light emission driving timing is as described above with reference to FIG. 6.

Figure 11:
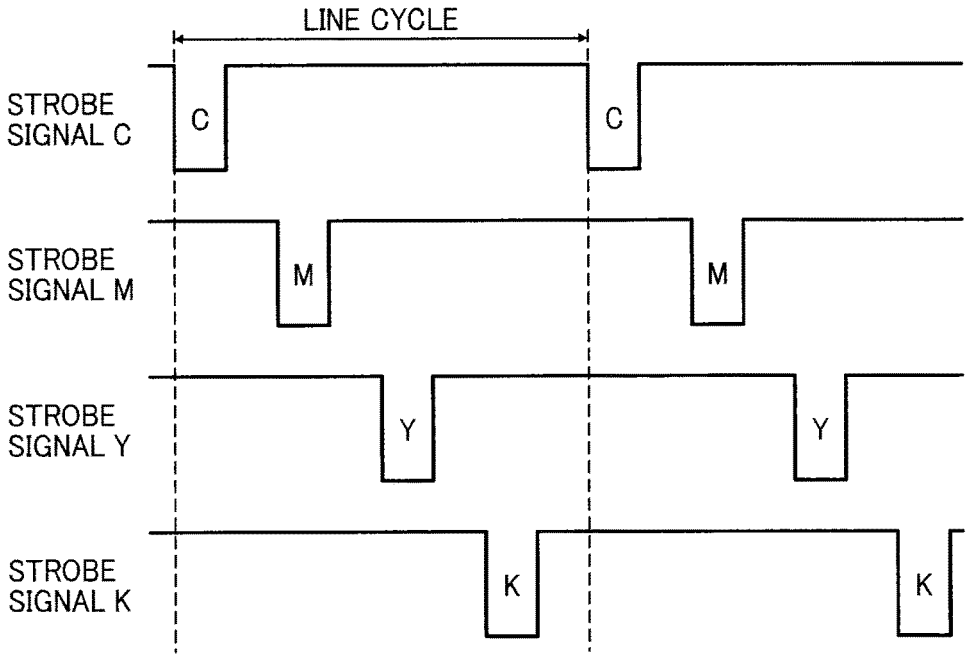
FIG. 11 is a timing chart illustrating a light emission driving timing in a discharge process according to the embodiment.

In contrast, in the discharge process, as illustrated in FIG. 11, light emission driving is performed at timings with each strobe interval being extended. In the example illustrated in FIG. 11, a strobe period has a doubled length of that in the example illustrated in FIG. 6.

Figure 12:
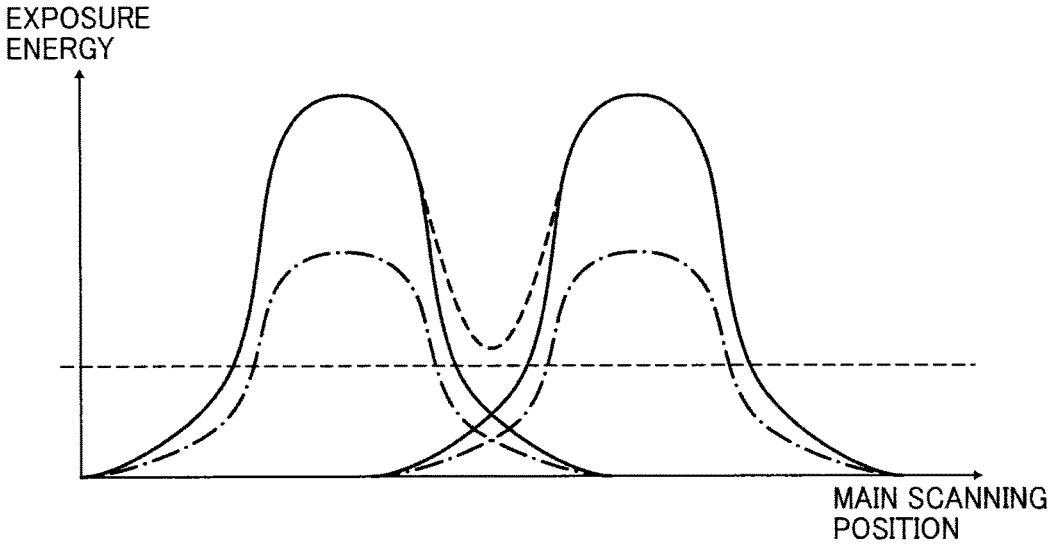
FIG. 12 is a diagram illustrating a state of an exposure energy corresponding to a main scanning position according to the embodiment.

FIG. 12 is a diagram illustrating an exposure energy corresponding to a main scanning position in a case in which a strobe period is doubled as illustrated FIG. 11, with comparison with FIG. 10. In FIG. 12, an exposure energy in FIG. 10 is indicated by a dashed-dotted line.

As illustrated in FIG. 12, by doubling the strobe period, the peak of an exposure energy that corresponds to an arrangement position of each LED element becomes higher, and a main scanning direction distribution of an exposure energy becomes higher as a whole. In addition, owing to the total exposure energies applied by the LED elements alternately driven to emit light, an exposure energy at a main scanning position corresponding to an arrangement position of a not-driven LED element can also exceed the discharge energy. As a result, exposure energies exceeding the discharge energy can be applied to the entire photoconductor drum 109.

Figure 13:
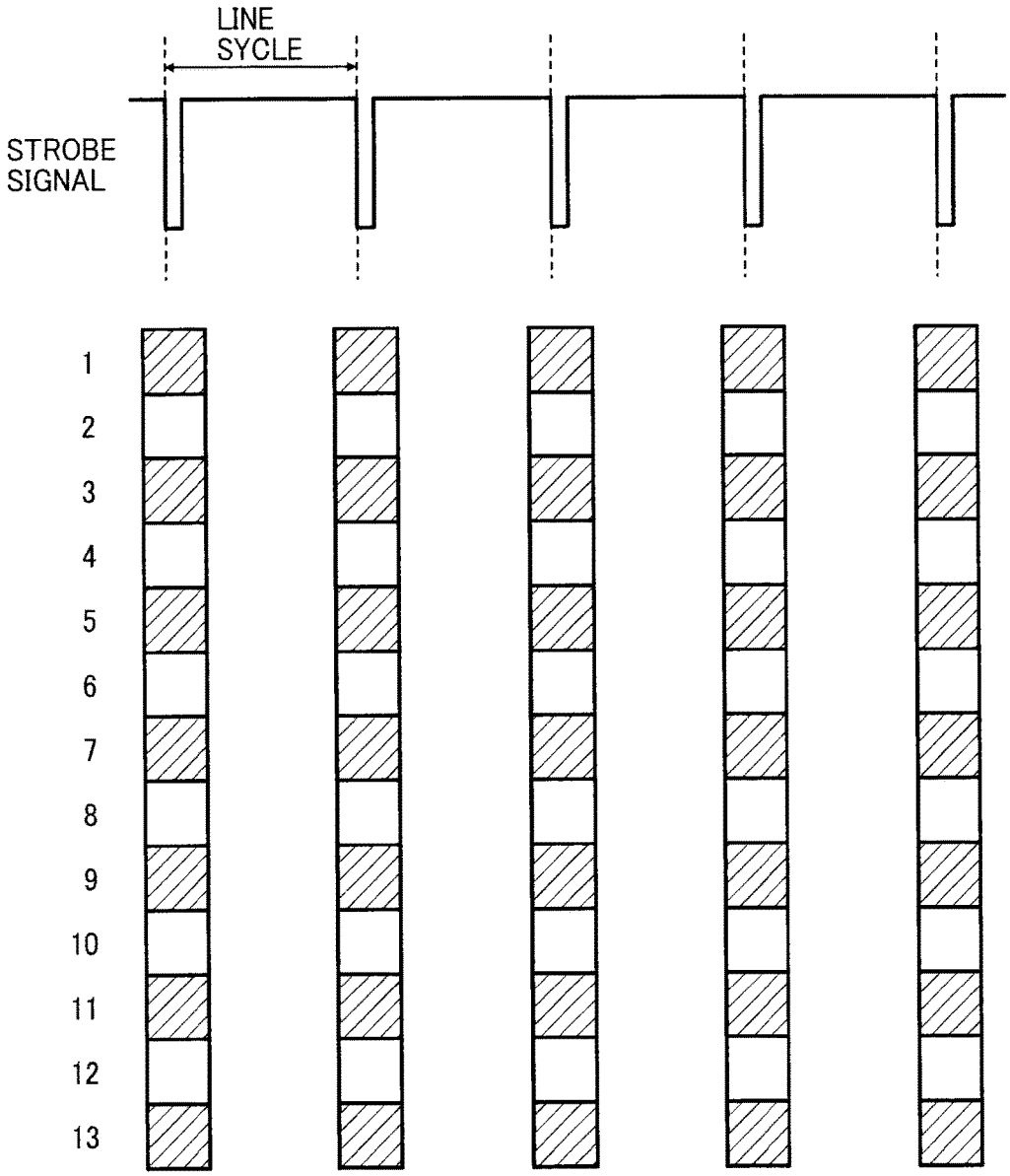
FIG. 13 is a diagram illustrating a lighting state of each LED element for each line cycle according to the embodiment.
Figure 14:
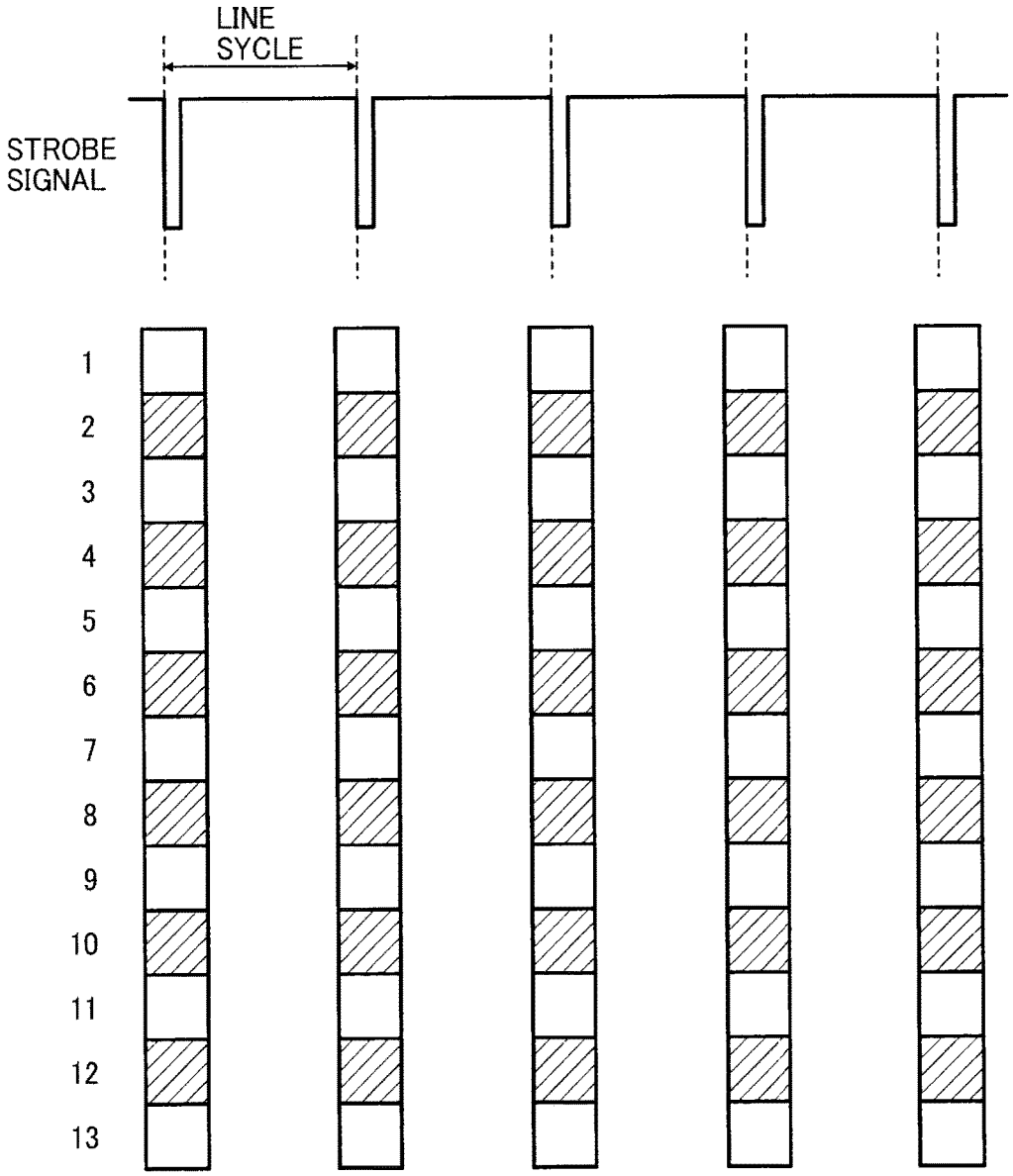
FIG. 14 is a diagram illustrating a lighting state of each LED element for each line cycle according to the embodiment.

FIGS. 13 and 14 are diagrams illustrating examples of LED elements turned on for each line cycle. As illustrated in FIGS. 6 and 11, lighting control is actually performed four times for CMYK in one line cycle. Nevertheless, FIGS. 13 and 14 illustrate one lighting control in one line cycle. In addition, FIGS. 13 and 14 illustrate LED elements assigned with the numbers from 1 to 13, as examples.

In the example illustrated in FIG. 13, only the LED elements assigned with the odd numbers such as "1", "3", "5", and so on are controlled to light up. In contrast, in the example illustrated in FIG. 14, only the LED elements assigned with the even numbers such as "2", "4", "6", and so on are controlled to light up. In both cases, a part of the LED elements are brought into an unlighted state. Thus, the number of LED elements controlled to light up becomes half of the total, so that the instantaneous consumed amount of current is reduced.

A control mode is switched between the control mode illustrated in FIG. 13 and the control mode illustrated in FIG. 14, to be used. In both of the control mode illustrated in FIG. 13 and the control mode illustrated in FIG. 14, an exposure energy sufficient for discharging can be ensured by extending a strobe period, as described with reference to FIGS. 11 and 12.

In contrast, in the case of alternately controlling LED elements to light up, the number of light emission drivings becomes inconsistent between LED elements controlled to light up and LED elements not controlled to light up during the discharging. This consequently generates a difference in time degradation. When there arises a difference in state among LED elements included in the same LEDA print head 130, even if the LED elements are driven under the same condition, light emission amounts become different from one another. As a result, a difference in image density is generated on a main scanning line.

In addition, in the case of alternately controlling LED elements to light up in a similar manner, as illustrated in FIG. 12, a difference in applied exposure energy is generated according to a main scanning position of the photoconductor drum 109. If this state continues for a long time, the cumulative exposure amount applied to the surface of the photoconductor drum 109 varies depending on positions. This generates a difference in chronological change of the material of the photoconductor drum surface.

In contrast, by using a mode while switching between the mode illustrated in FIG. 13 and the mode illustrated in FIG. 14, the number of light emission drivings can be prevented from becoming inconsistent among LED elements included in the same LEDA print head 130. In addition, such a problem that the cumulative exposure amount applied to the surface of the photoconductor drum 109 varies depending on positions can be solved. In addition, a mode of switching between the mode illustrated in FIG. 13 and the mode illustrated in FIG. 14 is considered to be switching for each job.

As described above, the discharge exposure is executed by the optical writing device 111 every time one job is completed. It is therefore considered that a mode is switched in such a manner that the mode in FIG. 13 is used after the first job is completed, and the mode in FIG. 14 is used after the second job is completed. The switching may not be performed every time one job is completed. Alternatively, the switching may be performed every time a plurality of jobs is completed, or may be performed on a time basis, instead of being performed for each job.

Figure 15:
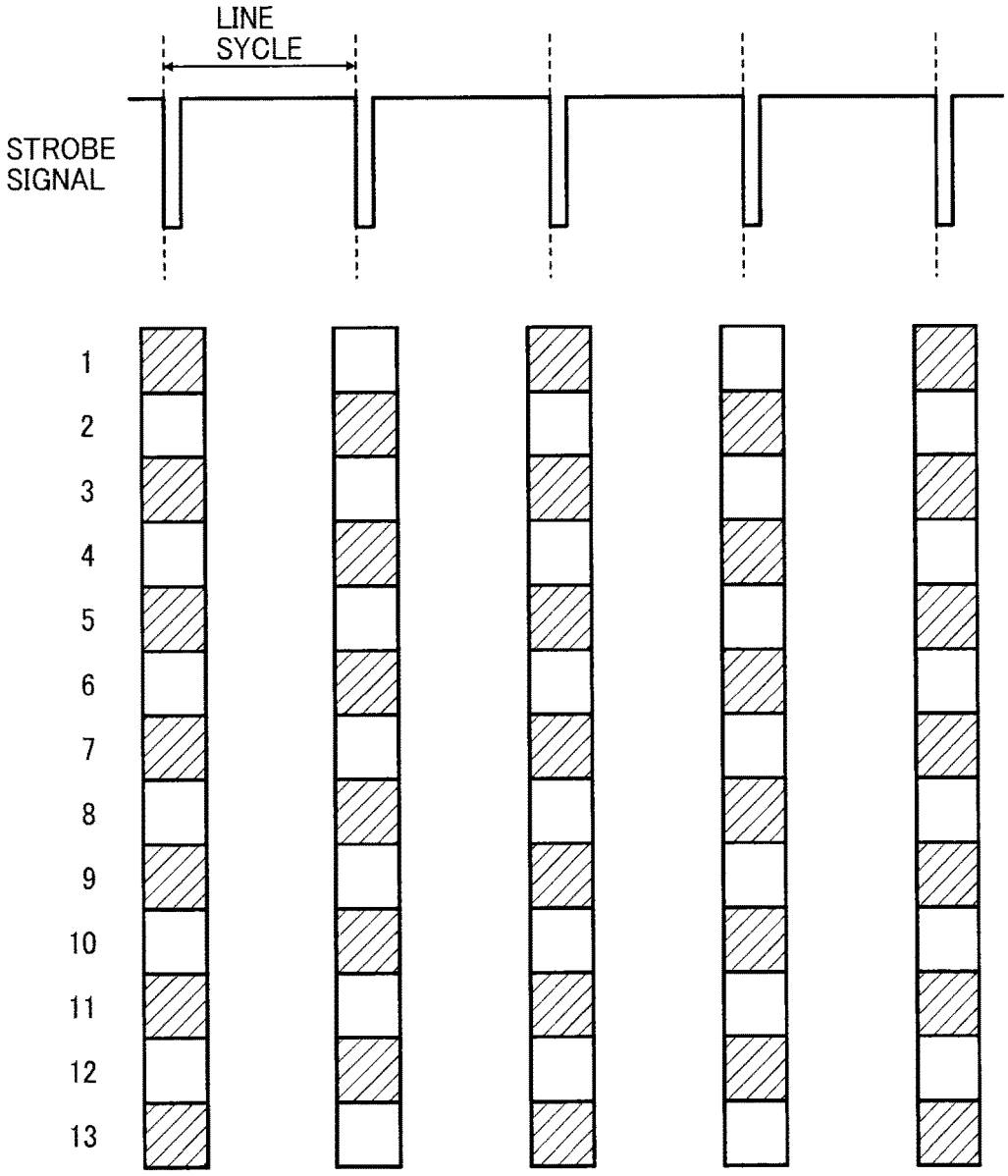
FIG. 15 is a diagram illustrating a lighting state of each LED element for each line cycle according to the embodiment.

FIG. 15 is diagram illustrating a switching mode different from those illustrated in FIGS. 13 and 14. In the example illustrated in FIG. 15, in performing lighting control for each line cycle, a mode of causing odd-numbered LED elements to emit light and a mode of causing even-numbered LED elements to emit light are switched for each line cycle. With this configuration, such a problem that the cumulative exposure amount applied to the surface of the photoconductor drum 109 varies depending on positions can be solved in a similar manner to the above-described case. In the mode illustrated in FIG. 15, the switching frequency is not limited to one line cycle basis, and the switching may be performed every plurality of line cycles.

In addition, by employing the mode illustrated in FIG. 15, among exposure energies obtained on the surface of the photoconductor drum 109, exposure energies on the portions not facing LED elements driven to emit light change. The exposure energies on the portions not facing the LED elements driven to emit light are covered by exposure energies applied by the surrounding LED elements driven to emit light, as described with reference to FIG. 12.

In this manner, the exposure energies applied by the surrounding LED elements driven to emit light decrease according to a distance from the LED elements driven to emit light. FIG. 16 is a diagram illustrating the states of surrounding LED elements that contribute to an exposure energy at a position farthest from LED elements driven to emit light, in the case of the modes illustrated in FIGS. 13 and 14. In addition, FIG. 17 is a diagram illustrating the states of surrounding LED elements that contribute to an exposure energy at a position farthest from LED elements driven to emit light, in the case of the mode illustrated in FIG. 15.

In each of FIGS. 16 and 17, the LED elements driven to emit light are indicated by hatched circles and LED elements caused to turn off are indicated by white circles. In addition, in each of FIGS. 16 and 17, the position farthest from the LED elements driven to emit light is indicated by a star sign. The point indicated by the star sign in each of FIGS. 16 and 17 is the position farthest from the LED elements driven to emit light, i.e., a position where an obtained exposure energy is the smallest. In addition, each of FIGS. 16 and 17 illustrates a case in which resolutions in the main scanning direction and a sub-scanning direction are the same, and the resolution is, for example, 1200 dpi×1200 dpi.

In this case, when a distance between adjacent LED elements is set to "1", in the case illustrated in FIG. 16, a distance from the position indicated by the star sign to the LED elements driven to emit light is $(5^{1/2})/2$. On the other hand, in the case illustrated in FIG. 17, a distance from the position indicated by the star sign to the LED elements driven to emit light is 1. In addition, the percentage of an obtained exposure energy with respect to a distance from the LED elements is as listed in FIG. 18, for example.

In the example illustrated in FIG. 18, when an exposure energy at the distance "0", i.e., at a position where an LED element is arranged is 100%, an exposure energy corresponding to a distance from light emission elements is 40% in a case in which the distance is "1", which is an interval between adjacent LED elements. In addition, an exposure energy is 25% in a case in which the distance is "$(5^{1/2})/2$", which is an interval between the star sign and the LED elements in the example illustrated in FIG. 16.

According to the example illustrated in FIG. 18, an exposure energy at the point indicated by the star sign in the case illustrated in FIG. 16 is 25%×4=100%. On the other hand, an exposure energy at the point indicated by the star sign in the case illustrated in FIG. 17 is 40%×4=160%. In other words, it can be seen that the mode illustrated in FIG. 17 is more advantageous in the exposure energy at the position indicated by the star sign.

FIGS. 16 to 18 merely illustrate examples. For example, the change in exposure energy according to a distance from the LED elements driven to emit light varies depending on the light emission characteristics of the LED elements. In addition, an interval between the position indicated by the star sign and the LED elements driven to emit light also changes according to the resolutions in the main scanning direction and the sub-scanning direction.

It is therefore preferable to select an optimum light emission pattern from among those illustrated in FIGS. 13 to 15 or other various light emission patterns of LED elements, based on an exposure energy corresponding to a distance from LED elements as illustrated in FIG. 18, and the resolutions in the main scanning direction and the sub-scanning direction. For example, the optimum light emission pattern here refers to a pattern in which an exposure energy at the point indicated by the star sign illustrated in FIG. 16 or 17, i.e., the position farthest from the LED elements driven to emit light becomes the largest.

On the other hand, as described above, in the example illustrated in FIG. 18, the exposure energy is 100% in the case illustrated in FIG. 16 and is 160% in the case illustrated in FIG. 17. In the mode illustrated in FIG. 17, an exposure energy can be made larger than that in the mode illustrated in FIG. 16, but the exposure energy applied to the point indicated by the star sign may be rather excessive because the exposure energy exceeds 100%. In such a case, by selecting the mode illustrated in FIG. 16, an exposure energy similar to that applied to the position facing the LED elements can be applied to the position indicated by the star sign.

On the other hand, an exposure energy may be adjusted by a strobe period. More specifically, in a case in which an exposure energy at the position indicated by the star sign exceeds 100% as in the example illustrated in FIG. 17, the excessive exposure may be suppressed by shortening a strobe period. In this case, the consumed power can be reduced in addition to the maximum consumed current.

Figure 19:
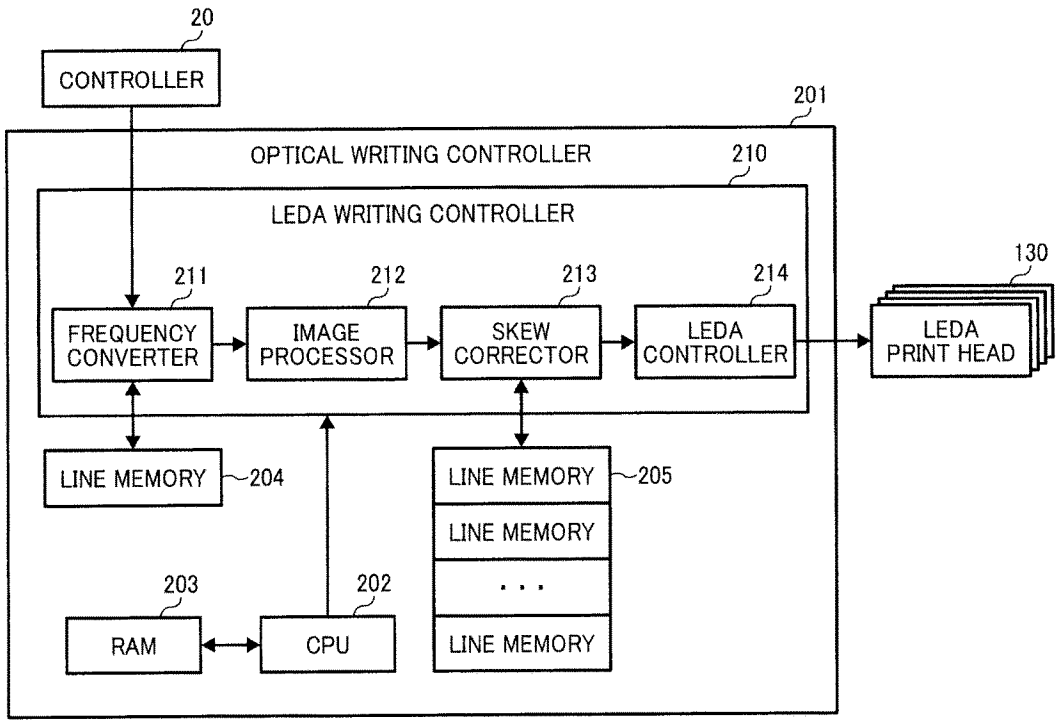
FIG. 19 is a diagram illustrating a functional configuration of an optical writing controller according to the embodiment.

Next, control blocks of the optical writing device 111 according to this embodiment will be described with reference to FIG. 19. FIG. 19 is a diagram illustrating a functional configuration of an optical writing controller 201 for controlling the LEDA print head 130, and a connection relationship with the LEDA print head 130 and the controller 20 in the optical writing device 111 according to this embodiment.

As illustrated in FIG. 19, the optical writing controller 201 includes a CPU 202 for controlling an operation of the entire optical writing device 111, a RAM 203 serving as a main storage device, line memories 204 and 205, and an LEDA writing controller 210. In addition, the LEDA writing controller 210 includes a frequency converter 211, an image processor 212, a skew corrector 213, and an LEDA controller 214.

In this manner, similarly to the hardware configuration described with reference to FIG. 1, the optical writing controller 201 is formed by the combination of a software controller and hardware. The software controller is formed by a control program stored in a storage medium being loaded into the RAM 203, and the CPU 202 performing calculation according to the program. The optical writing controller 201 functions as an optical writing control device.

The LEDA writing controller 210 serves as a control circuit for controlling the light emission of the LEDA print head 130 based on rendering information input from the controller 20, and includes an integrated circuit and the like. The LEDA writing controller 210 operates according to the control of the CPU 202.

The frequency converter 211 outputs the rendering information input from the controller 20, in accordance with an operating frequency of the LEDA writing controller 210. Thus, the frequency converter 211 temporarily stores the rendering information input from the controller 20, into the line memory 204 provided for frequency conversion, and outputs the rendering information in accordance with an operating frequency of the LEDA writing controller 210. The frequency converter 211 also functions as an image information acquisition unit for acquiring image information input from the controller 20.

The image processor 212 performs various types of image processing on image data that has been output after having been subjected to the frequency conversion. Examples of image processing performed by the image processor 212 include image size change, trimming processing, the addition of an internal pattern, and the like. In addition, the image processor 212 performs binarization processing of converting the rendering information input from the frequency converter 211 as multi-tone image information, into a duotone of chromatic and achromatic, and finally generating pixel information for performing light emission control of the LEDA print head 130.

Furthermore, in the discharge process, the image processor 212 generates data for performing thinned-out lighting control of LED elements (may be referred to as the "discharge data") as described with reference to FIGS. 13 to 15. In the image formation output, the lighting state of the LED elements is controlled based on image data. Thus, for realizing the lighting states as illustrated in FIGS. 13 to 15, image data corresponding to these states are required.

In the discharge process, the image processor 212 generates data for realizing the lighting states as illustrated in FIGS. 13 to 15, and outputs the generated data similarly to image data in the image formation output. Through the process, the thinned-out lighting control as illustrated in FIGS. 13 to 15 is achieved.

The skew corrector 213 corrects the skew of an image that arises from various factors such as an arrangement error of the LEDA print head 130 and the photoconductor drum 109. Parameter values related to skew correction are stored in a storage device included in the optical writing controller 201, and are set in the skew corrector 213 according to the control of the CPU 202. The skew corrector 213 stores image data input from the image processor 212, into the line memory 205 for each main scanning line, and reads the image data from the line memory 205 according to the set parameter values to execute skew correction.

In a state in which pixel data corresponding to a plurality of main scanning lines are stored in the line memory 205, the skew corrector 213 shifts a line from which pixel data is to be read, at a predetermined position on a main scanning line, according to the skew of an image that is to be corrected. For example, when pixel data is read from the first line, at a predetermined position on a main scanning line (hereinafter, referred to as a "shift position"), the main scanning line from which pixel data is read is switched to the second line. Through such a process, the skew of the image can be corrected.

In addition, as described above, data for realizing the lighting state as illustrated in FIGS. 13 to 15 in the discharge process is also input from the image processor 212 to the skew corrector 213 in a similar manner to normal image data. Nevertheless, it is not necessary to perform skew correction in the discharge process. Thus, in the discharge process, the control of omitting skew correction performed by the skew corrector 213 is preferable.

The omission of skew correction is realized by, for example, setting a parameter indicating non-existence of skew, as a parameter set by the CPU 202 as described above. As a result, the skew corrector 213 directly reads image data written into the line memory 205. Thus, an image shift in the sub-scanning direction is not performed.

In addition, data may be directly input to the LEDA controller 214 by bypassing the skew corrector 213.

Based on pixel information output from the skew corrector 213, the LEDA controller 214 controls the light emission of the LEDA print head 130 according to an operating frequency. In other words, the LEDA controller 214 functions as a light source controller.

As illustrated in FIG. 6, the LEDA controller 214 controls the light emission timings of the respective colors so that the light emission periods of the LEDA print heads 130 corresponding to the respective colors of CMYK do not overlap with one another.

Figure 20:
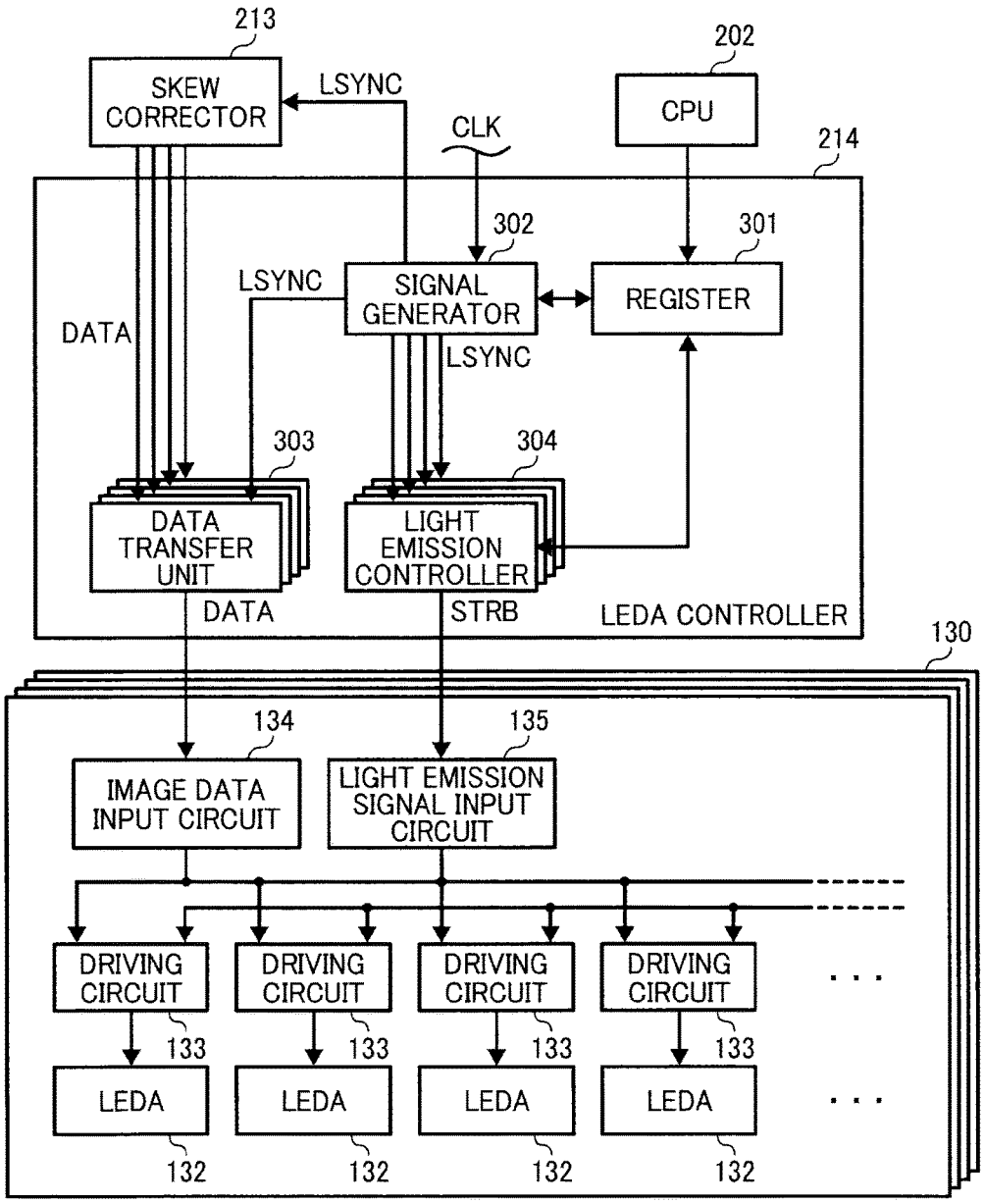
FIG. 20 is a diagram illustrating a functional configuration of an LEDA controller according to the embodiment.

Next, specific configurations of the LEDA controller 214 and the LEDA print head 130 will be described with reference to FIG. 20. FIG. 20 is a diagram illustrating functional configurations of the LEDA controller 214 and the LEDA print head 130 and a connection relationship therebetween. As illustrated in FIG. 20, the LEDA controller 214 includes a register 301, a signal generator 302, a data transfer unit 303, and a light emission controller 304.

The register 301 is a storage for storing parameter values set by the CPU 202. Based on a reference clock CLK input from the outside of the LEDA controller 214, the signal generator 302 generates and outputs a line cycle signal LSYNC indicating a light emission cycle of the LEDA print head 130 of each main scanning line. The LSYNC corresponds to a main scanning synchronization signal indicating the cycle of each main scanning line. The signal generator 302 generates and outputs the LSYNC for each color of CMYK.

The data transfer unit 303 transfers, to the LEDA print head 130, image data DATA input from the skew corrector 213, according to the timing of the LSYNC input from the signal generator 302. The data transfer units 303 are provided so as to correspond to the respective LEDA print heads 130 of the respective colors of CMYK. In addition, the skew corrector 213 inputs image data DATA of the respective colors of CMYK to the data transfer units 303 corresponding to the respective colors.

According to the timing of the LSYNC input from the signal generator 302, the light emission controller 304 outputs a strobe signal STRB for performing light emission control of the LEDA print head 130. The light emission controllers 304 are provided so as to correspond to the respective LEDA print heads 130 of the respective colors of CMYK. Thus, the signal generator 302 outputs LSYNCs generated for the respective colors of CMYK, to the light emission controllers 304 corresponding to the respective colors.

At this time, in normal image formation output, the light emission controllers 304 each output the strobe signal STRB in the mode illustrated in FIG. 6, whereas in the discharge process, the light emission controllers 304 each output the strobe signal STRB in the mode illustrated in FIG. 11. This setting is performed by the setting of the CPU 202 with respect to the register 301. Based on a setting value being set in the register 301 and indicating whether to perform an image forming process or the discharge process, the light emission controller 304 switches the period of a strobe signal STRB to be output. Through the process, switching between a strobe period as illustrated in FIG. 6 and a strobe period as illustrated in FIG. 11 is realized.

In the LEDA print head 130 of each color of CMYK, a light emission signal input unit 135 acquires the STRB input from the light emission controller 304, and inputs the STRB to the driving circuits 133 corresponding to the respective LEDAs 132.

A data signal DATA input from the data transfer unit 303 is acquired by an image data input unit 134 in the LEDA print head 130, and input to the driving circuits 133 corresponding to the respective LEDAs 132. The image data input unit 134 develops the data signal DATA input as serial data, into parallel data. Thus, the image data input unit 134 includes, for example, a shift register.

Based on the DATA input from the image data input unit 134, the driving circuits 133 switch the lighted/unlighted state of a plurality of LED elements included in the LEDAs 132, and drive the LEDAs 132 to emit light, according to the strobe signal STRB input from the light emission signal input unit 135.

In the discharge process, the data signal DATA of the image data corresponding to the lighting control for the discharge process that has been generated by the image processor 212 as described above is transferred from the data transfer unit 303 to the image data input unit 134. The data is input from the image data input unit 134 to the driving circuits 133, so that the lighting states as illustrated in FIGS. 13 to 15 are realized.

As described above, in an image forming apparatus equipped with an optical writing device, a discharge process is performed by a linear light source for performing optical writing. During the discharge process, thinned-out lighting control of thinning out, at equal intervals, LED elements caused to emit light is performed for reducing the instantaneous consumed amount of current.

To avoid a state in which sufficient exposure cannot be performed because exposure energies applied to the surface of the photoconductor drum 109 become insufficient due to such thinned-out lighting control, a strobe period in one lighting control is made longer than that in normal image formation output. Such a mode enables both sufficient discharge exposure and the reduction of the instantaneous consumed amount of current in the discharge process.

In addition, in the above-described embodiment, the description has been given of an example case of setting a strobe period in the discharge process to the double of a strobe period in the normal image formation output. This, however, is an example. It is preferable to extend the strobe period without excess and deficiency to such an extent that the shortage in exposure energy that is caused by thinned-out lighting control can be compensated for.

Thus, if the doubled strobe period is not sufficient, a strobe period exceeding the doubled strobe period needs to be set. On the other hand, one exposure needs to be finished within one line cycle, and exposures for four colors of CMYK need to be finished within one line cycle as illustrated in FIGS. 6 and 11. Thus, the maximum strobe period settable by extension is a period corresponding to one-quarter of one line cycle.

In addition, in the above-described embodiment, alternate lighting control of turning on either odd-numbered elements or even-numbered elements as illustrated in FIGS. 13 to 15 has been described as an example of the mode of the thinned-out lighting control. This, however, is an example, and another mode may be employed as long as the mode thins out LED elements caused to light up, to reduce the instantaneous consumed amount of current.

As an example of another mode, the following modes can be employed. One example mode performs control so as to turn off one element every time causing two elements to emit light, in the main scanning direction. Another example mode similarly performs control so as to turn off four elements after causing four elements to emit light. The control mode is not limited to these modes, and any mode can be realized as long as the mode has a configuration in which groups of LED elements caused to emit light and groups of LED elements caused not to emit light are periodically arranged.

Nevertheless, by employing alternate lighting control, exposure energies at positions corresponding to turned-off LED elements can be compensated for by exposure energies applied by LED elements arranged on the both sides of the turned-off LED elements. As a result, the above-described supplementation of exposure energies by extending a strobe period can be suitably achieved.

Second Embodiment

While the above-described embodiment is an example of performing optical writing using a linear light source, the following second embodiment is an example of performing optical writing using a rotating reflection light source operated by reflection on a polygon mirror. In addition, the technical features described with reference to FIGS. 1 to 6 in the above-described embodiment are similar in the second embodiment. Thus, the redundant descriptions will be omitted.

FIG. 21 is a top view illustrating an optical writing device 111 in the case of using a rotating reflection light source for performing scanning by reflecting, off a rotating polygon mirror, laser beams emitted from laser diode (LD) light sources. In addition, FIG. 22 is a sectional side view illustrating the optical writing device 111 using the rotating reflection light source.

As illustrated in FIGS. 4 and 5, laser beams for performing writing on the photoconductor drums 109BK, 109M, 109C, and 109Y of the respective colors are emitted from LD light sources 281BK, 281Y, 281M, and 281C (hereinafter, collectively referred to as an LD light source 281). In addition, the LD light source 281 includes a semiconductor laser, a collimator lens, a slit, a prism, a cylinder lens, and the like.

The laser beams emitted from the LD light sources 281 are reflected by a reflecting mirror 280. The laser beams are guided to respective mirrors 282BK, 282Y, 282M, and 282C (hereinafter, collectively referred to as a mirror 282) through an optical system such as an fθ lens (not illustrated), and further through an optical system provided ahead thereof, the laser beams are scanned over the surfaces of the respective photoconductor drums 109BK, 109M, 109C, and 109Y.

The reflecting mirror 280 is a hexahedral polygon mirror. By rotating, the reflecting mirror 280 can scan a laser beam corresponding to a line in the main scanning direction for each surface of the polygon mirror. The optical writing device 111 divides four light source devices into two each including light source devices of two colors, i.e., the LD light sources 281BK and 281Y, and the LD light sources 281M and 281C, and performs scanning using different reflection surfaces of the reflecting mirror 280. This enables simultaneous writing onto four different photoconductor drums, with a more compact configuration than that in a method of performing scanning using only one reflection surface.

In addition, a horizontal synchronization detection sensor 283 is provided near a scanning start position in a range in which the laser beams are scanned by the reflecting mirror 280. When a laser beam emitted from the LD light source 281 enters the horizontal synchronization detection sensor 283, the timing of a scanning start position of a main scanning line is detected, so that a control device for controlling the LD light source 281 and the reflecting mirror 280 are synchronized.

FIG. 23 is a diagram illustrating an operating state of an image forming apparatus 1 according to this embodiment and a rotating state of a photoconductor drum 109, in chronological order. FIG. 23 illustrates an example case of performing print output corresponding to two pages. As illustrated in FIG. 23, when the image forming apparatus 1 performs print output corresponding to two pages, a state shifts in the order of "standby", "printing the first page", "printing the second page", "discharging", and "standby".

Meanwhile, as illustrated in FIG. 23, the rotating state of the photoconductor drum 109 is "stop" when the state of the image forming apparatus 1 is "standby". In addition, when the state of the image forming apparatus 1 is any of "printing the first page", "printing the second page", and "discharging", the rotating state of the photoconductor drum 109 is "rotating". Through such control, a discharge process is executed for each print job, so that image density in the next print job can be stabilized.

In addition, by performing the discharge process while maintaining the rotating speed of the photoconductor drum 109 in the print output, the downtime of the image forming apparatus 1 that is caused by the discharge process can be minimized.

Figure 24:
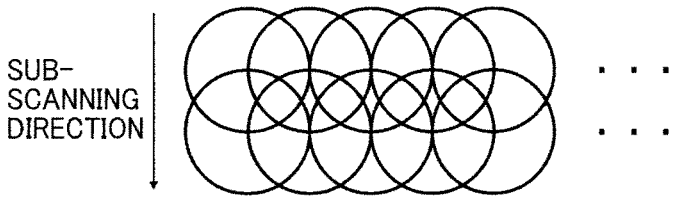
FIG. 24 is a diagram illustrating an arrangement state of an exposure spot on the photoconductor of FIG. 21.

Next, a relationship between an arrangement state of an exposure spot on the photoconductor drum 109, and an exposure energy will be described. FIG. 24 is a diagram illustrating an arrangement state of an exposure spot on the surface of the photoconductor drum 109 in a case in which the optical writing device 111 is driven with a resolution in the sub-scanning direction that is similar to that in the print output.

Figure 25:
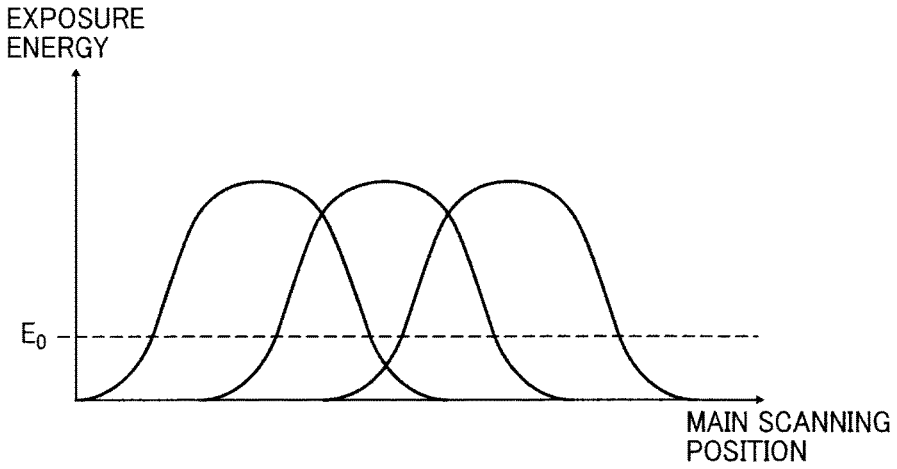
FIG. 25 is a diagram illustrating a distribution of an exposure energy corresponding to an arrangement state of an exposure spot on the photoconductor according to an embodiment of the present invention.

In addition, FIG. 25 is a diagram illustrating the intensity of an exposure energy corresponding to each pixel, for each position on the photoconductor surface in the case illustrated in FIG. 24, and an exposure energy $E_0$ necessary for discharging (hereinafter, referred to as "discharge energy $E_0$"), using a broken line. In addition, a spot diameter of an exposure spot in FIG. 24 is a diameter within a range in which the discharge energy $E_0$ is satisfied in FIG. 25.

As illustrated in FIG. 24, an exposure energy applied by each LED element has a distribution with a peak at a position corresponding to an exposure point of each pixel. In addition, if a shift occurs from an arrangement position of each exposure point, an exposure range of adjacent another pixel is reached before an exposure energy applied to one pixel falls below the discharge energy. As a result, as illustrated in FIG. 25, exposure energies exceeding the discharge energy can be applied to the entire surface of the photoconductor drum 109.

In the case illustrated in FIGS. 24 and 25, exposure energies applied to the photoconductor drum 109 far exceed the discharge energy $E_0$ in the entire range in the sub-scanning direction. In other words, when the optical writing device 111 is driven to perform the discharge process in the driving mode illustrated in FIGS. 24 and 25, the exposure energies applied to the photoconductor drum 109 are redundant, and an excess consumed amount of power is generated.

Figure 26:
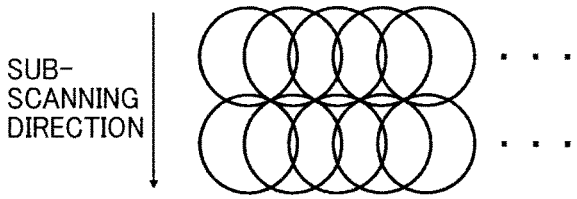
FIG. 26 is a diagram illustrating an arrangement state of an exposure spot on the photoconductor according to the embodiment.

In contrast, FIG. 26 is a diagram illustrating an arrangement state of an exposure spot in a case in which the resolution in the sub-scanning direction is decreased by widening an interval between main scanning lines. In FIG. 26, an interval between main scanning lines is widened so that exposure spots on the photoconductor drum 109 nearly cover the entire surface of the photoconductor drum 109.

Figure 27:
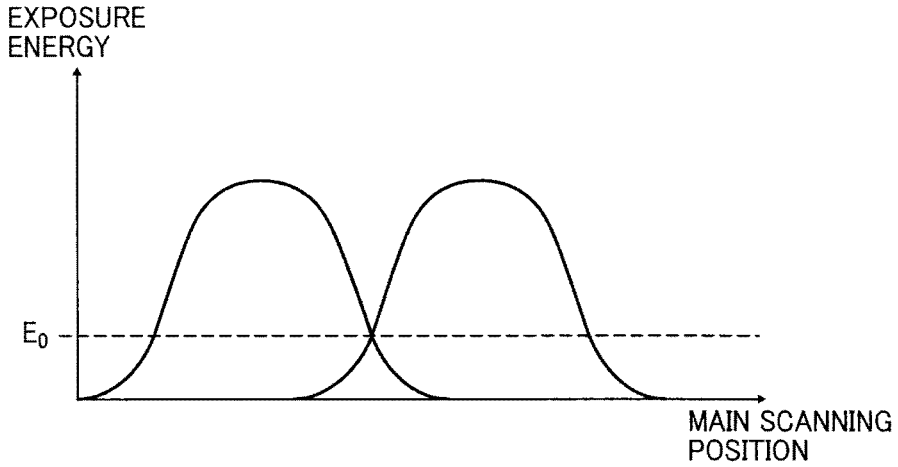
FIG. 27 is a diagram illustrating a distribution of an exposure energy corresponding to an arrangement state of an exposure spot on the photoconductor according to the embodiment of the present invention.

FIG. 27 is a diagram illustrating the intensity of an exposure energy applied to each pixel, for each sub-scanning position in the case illustrated FIG. 26, and the discharge energy $E_0$ using a broken line.

In the case illustrated in FIGS. 26 and 27, ranges in which exposure spots exceed the discharge energy $E_0$ are tightly-arranged on the photoconductor drum 109. Thus, as illustrated in FIG. 13 using a solid line, the entire surface of the photoconductor drum 109 can be sufficiently discharged. In addition, the amount of consumed power can be reduced more than the example illustrated in FIGS. 24 and 25.

Figure 28:
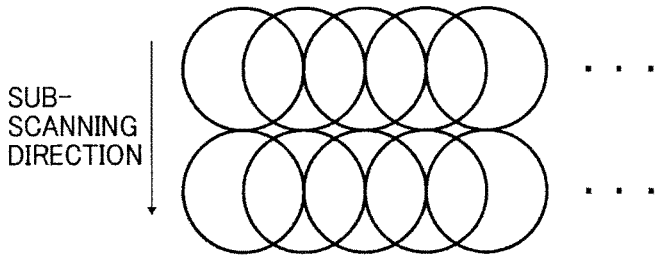
FIG. 28 is a diagram illustrating an arrangement state of an exposure spot on the photoconductor according to the embodiment.

FIG. 28 is a diagram illustrating an arrangement state of an exposure spot in a case in which the resolution in the sub-scanning direction is further decreased by further widening an interval between main scanning lines than the mode illustrated in FIG. 12. In FIG. 28, on the photoconductor drum 109, there is a range not covered by an exposure spot.

Figure 29:
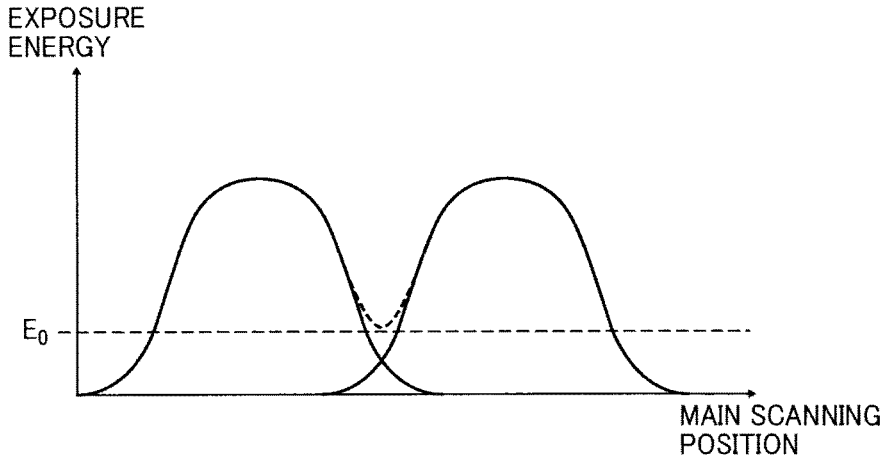
FIG. 29 is a diagram illustrating a distribution of an exposure energy corresponding to an arrangement state of an exposure spot on the photoconductor according to the embodiment.

FIG. 29 is a diagram illustrating the intensity of an exposure energy applied to each pixel, for each sub-scanning position in the case illustrated FIG. 27, and the discharge energy $E_0$ using a broken line.

In the case illustrated in FIGS. 28 and 29, there is a range in which an exposure spot falls below the discharge energy $E_0$, on the surface of the photoconductor drum 109. In contrast, as illustrated in FIG. 29 using a dotted line, even at a position where an exposure energy corresponding to each pixel does not exceed the discharge energy $E_0$, when exposure energies corresponding to a plurality of pixels are superimposed, the obtained exposure energy exceeds the discharge energy $E_0$.

Thus, also in the mode illustrated in FIGS. 28 and 29, the entire surface of the photoconductor drum 109 can be sufficiently discharged. In addition, the amount of consumed power can be reduced more than the example illustrated in FIGS. 26 and 27.

In normal print output, for higher image quality and finer skew correction of an image, the optical writing device 111 performs lighting control of the light source devices using high resolution as illustrated in FIGS. 24 and 25. In contrast, in the discharge process, the optical writing device 111 performs lighting control with a decreased resolution in the sub-scanning direction as illustrated in FIGS. 26 and 28, so as to reduce the amount of consumed power while maintaining a sufficient discharge effect.

In the case of the linear light source illustrated in FIG. 4, the optical writing device 111 adjusts a line cycle described with reference to FIG. 6, thereby changing the resolution in the sub-scanning direction as illustrated in FIG. 24, 26, or 28. On the other hand, in the case of the rotating reflection light source illustrated in FIG. 7, it is necessary to control the rotating speed of the reflecting mirror 280 for adjusting a line cycle. It takes proportionate time for adjusting and stabilizing the rotating speed of the reflecting mirror 280. Thus, if the adjustment and stabilization are executed, the period of "discharging" illustrated in FIG. 23 becomes longer, so that the downtime of the apparatus becomes longer.

Figure 30:
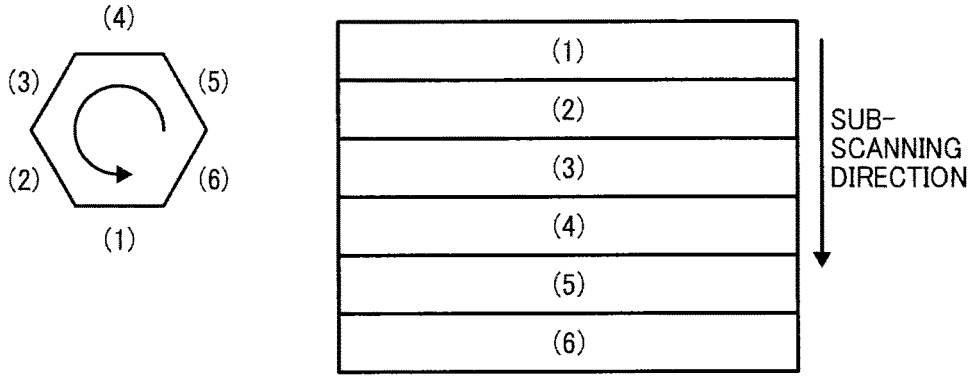
FIG. 30 is a diagram illustrating a relationship between reflection surfaces of a polygon mirror and a main scanning line according to the embodiment.

Thus, in the case of using a rotating reflection light source, the optical writing device 111 adjusts the resolution in the sub-scanning direction by thinning out main scanning lines. FIG. 30 is a diagram illustrating a concept in such a case.

As illustrated in FIG. 30, the reflecting mirror 280 has six reflection surfaces, and each surface performs scanning corresponding to one main scanning line. In addition, scanning corresponding to six lines is performed by rotating once. In such a case, for example, by emitting laser beams only to reflection surfaces corresponding to odd numbers or even numbers, main scanning lines are thinned out every other line. As a result, the resolution in the sub-scanning direction can be halved.

Figure 31:
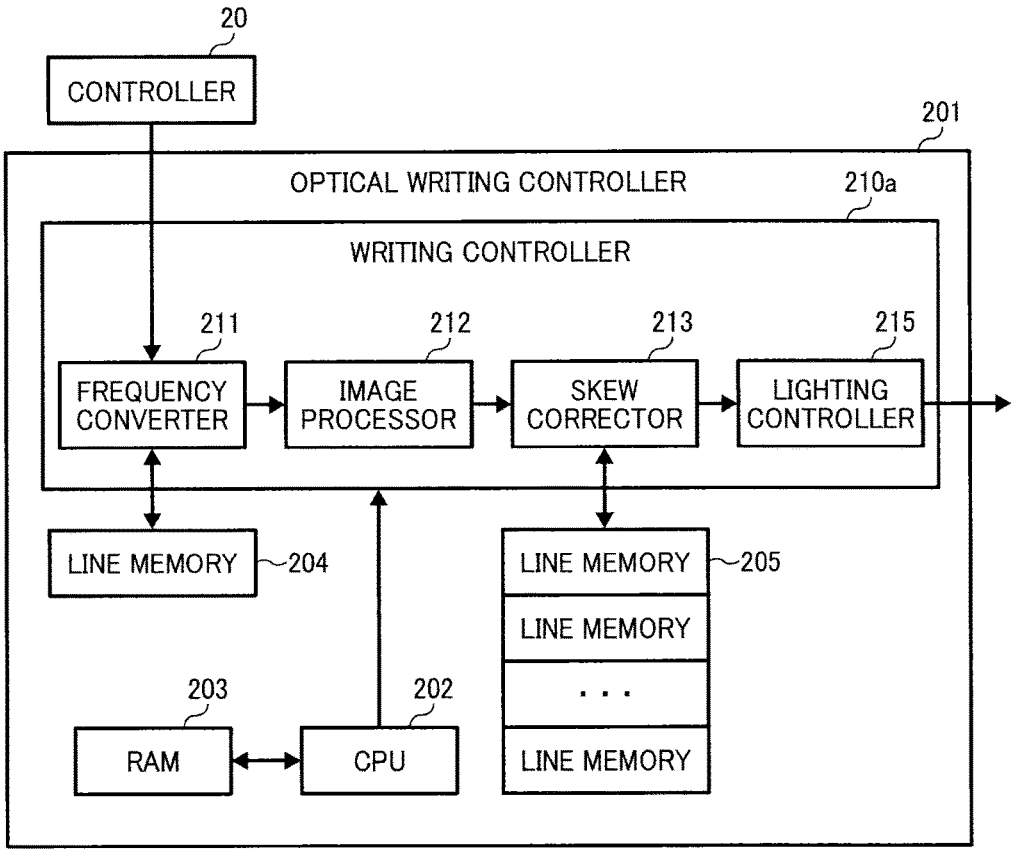
FIG. 31 is a diagram illustrating a functional configuration of an optical writing controller according to the embodiment.

Next, control blocks of the optical writing device 111 will be described with reference to FIG. 31. FIG. 31 is a diagram illustrating functional configurations of an optical writing controller 201 for controlling light source devices of an LEDA print head 130, an LD light source 281, or the like in the optical writing device 111, and a connection relationship with a controller 20.

As illustrated in FIG. 31, the optical writing controller 201 includes a CPU 202 for controlling an operation of the entire optical writing device 111, a RAM 203 serving as a main storage device, line memories 204 and 205, and a writing controller 210*a*. In addition, the writing controller 210*a* includes a frequency converter 211, an image processor 212, a skew corrector 213, and a lighting controller 215.

In this manner, similarly to the hardware configuration described with reference to FIG. 1, the optical writing controller 201 is formed by the combination of a software controller and hardware. The software controller is formed by a control program stored in a storage medium being loaded into the RAM 203, and the CPU 202 performing calculation according to the program. The optical writing controller 201 functions as an optical writing control device.

The writing controller 210*a* serves as a control circuit for controlling the light emission of the LEDA print head 130 and the LD light source 281 based on rendering information input from the controller 20, and includes an integrated circuit and the like. The writing controller 210*a* operates according to the control of the CPU 202.

The frequency converter 211 outputs the rendering information input from the controller 20, in accordance with an operating frequency of the writing controller 210*a*. Thus, the frequency converter 211 temporarily stores the rendering information input from the controller 20, into the line memory 204 provided for frequency conversion, and outputs the rendering information in accordance with an operating frequency of the writing controller 210*a*. The frequency converter 211 also functions as an image information acquisition unit for acquiring image information input from the controller 20.

The image processor 212 performs various types of image processing on image data that has been output after having been subjected to the frequency conversion. Examples of image processing performed by the image processor 212 include image size change, trimming processing, the addition of an internal pattern, and the like. In addition, the image processor 212 performs binarization processing of converting the rendering information input from the frequency converter 211 as multi-tone image information, into a duotone of chromatic and achromatic, and finally generating pixel information for performing light emission control of the LEDA print head 130 or the LD light source 281.

Furthermore, in the discharge process, the image processor 212 generates data for turning on LED elements or the LD light sources 281 for the discharge process (hereafter, referred to as "discharge data"). In the discharge process, the discharge energy $E_0$ is applied to the entire surface of the photoconductor drum 109. Thus, the discharge data is, for example, a solid image.

On the other hand, the discharge data does not have to be a solid image as long as the discharge energy $E_0$ can be obtained from exposure energies corresponding to adjacent pixels as described above with reference to FIG. 29. Thus, as discharge data, the image processor 212 may generate discharge data including such a chromatic pixel pattern that the discharge energy $E_0$ is applied to the entire surface of the photoconductor drum 109. The discharge data is generated according to the above-described resolution in the sub-scanning direction.

The skew corrector 213 corrects the skew of an image that arises from various factors such as an arrangement error of the LEDA print head 130 and the photoconductor drum 109 and an arrangement error of the LD light source 281 and the reflecting mirror 280. Parameter values related to skew correction are stored in a storage device included in the optical writing controller 201, and are set in the skew corrector 213 according to the control of the CPU 202. The skew corrector 213 stores image data input from the image processor 212, into the line memory 205 for each main scanning line, and reads the image data from the line memory 205 according to the set parameter values to execute skew correction.

In a state in which pixel data corresponding to a plurality of main scanning lines are stored in the line memory 205, the skew corrector 213 shifts a line from which pixel data is to be read, at a predetermined position on a main scanning line, according to the skew of an image that is to be corrected. For example, when pixel data is read from the first line, at a predetermined position on a main scanning line (hereinafter, referred to as a "shift position"), the main scanning line from which pixel data is read is switched to the second line. Through such a process, the skew of the image can be corrected.

In addition, as described above, the discharge data generated by the image processor 212 in the discharge process is also input from the image processor 212 to the skew corrector 213 in a similar manner to normal image data. Nevertheless, it is not necessary to perform skew correction in the discharge process. Thus, in the discharge process, the control of omitting skew correction performed by the skew corrector 213 is preferable.

The omission of skew correction is realized by, for example, setting a parameter indicating non-existence of skew, as a parameter set by the CPU 202 as described above. As a result, the skew corrector 213 directly reads image data written into the line memory 205. Thus, an image shift in the sub-scanning direction is not performed. In addition, data may be directly input to the lighting controller 215 by bypassing the skew corrector 213.

Based on pixel information output from the skew corrector 213, the lighting controller 215 controls the light emission of the LEDA print head 130 or the LD light source 281 according to an operating frequency. In other words, the lighting controller 215 functions as a light source controller.

Figure 32:
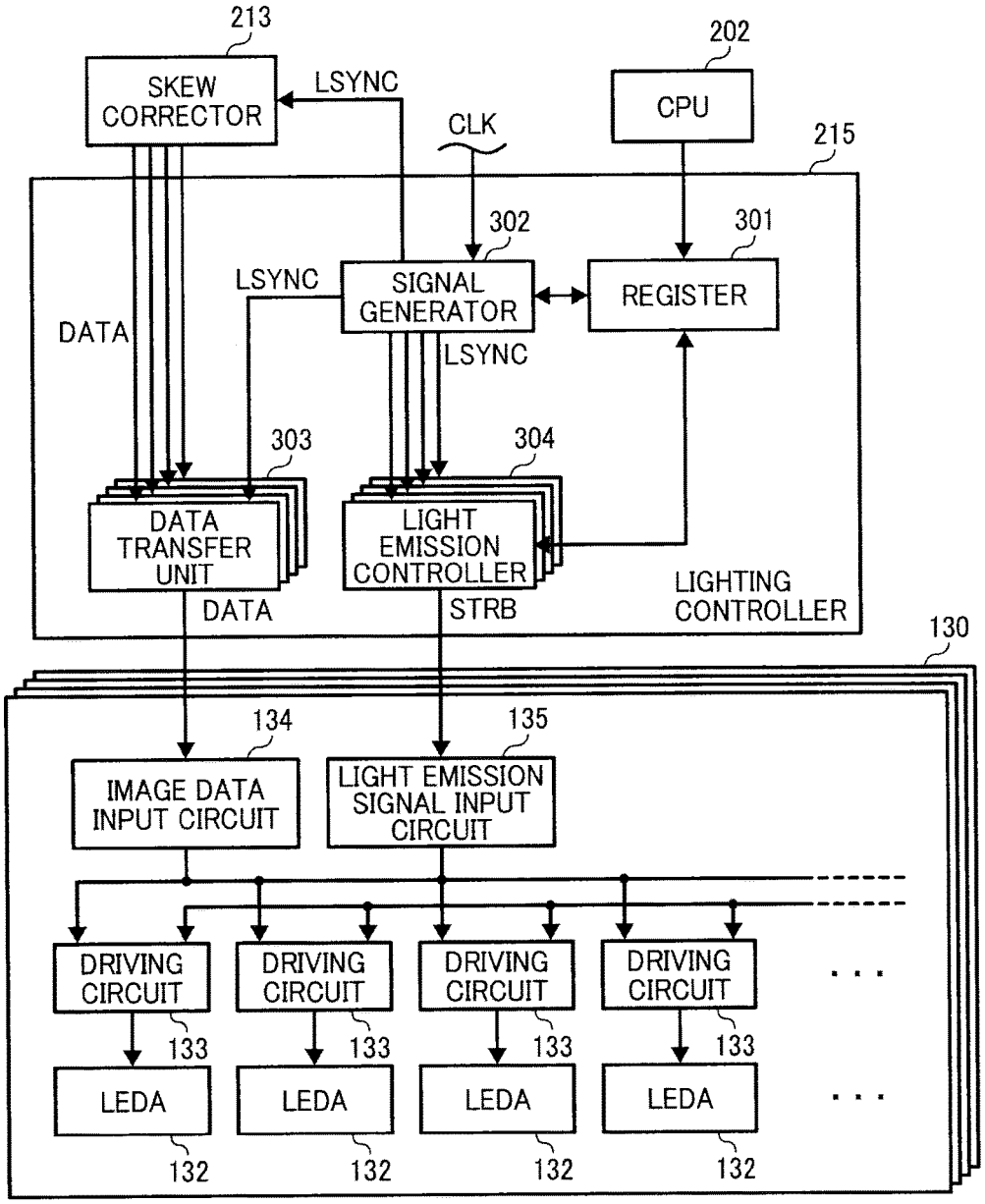
FIG. 32 is a diagram illustrating a functional configuration of an LEDA controller according to the embodiment.

Next, a specific configuration of the lighting controller 215 will be described. FIG. 32 is a block diagram illustrating a functional configuration of the lighting controller 215 in the case of using the LEDA print head 130, i.e., a functional configuration of the lighting controller 215 corresponding to a linear light source, and a configuration of the LEDA print head 130. As illustrated in FIG. 32, the lighting controller 215 corresponding to a linear light source includes a register 301, a signal generator 302, a data transfer unit 303, and a light emission controller 304.

The register 301 is a storage for storing parameter values set by the CPU 202. Based on a reference clock CLK input from the outside of the lighting controller 215, the signal generator 302 generates and outputs a line cycle signal LSYNC indicating a light emission cycle of the LEDA print head 130 of each main scanning line. The LSYNC corresponds to a main scanning synchronization signal indicating the cycle of each main scanning line. The signal generator 302 generates and outputs the LSYNC for each color of CMYK.

Here, the cycle of the LSYNC output by the signal generator 302 is a cycle corresponding to FIG. 24 in the normal print output, and is a cycle corresponding to FIG. 26 or 28 in the discharge process. The cycle of the LSYNC is set by the CPU 202 writing a setting value in the register 301.

The data transfer unit 303 transfers, to the LEDA print head 130, image data DATA input from the skew corrector 213, according to the timing of the LSYNC input from the signal generator 302. The data transfer units 303 are provided so as to correspond to the respective LEDA print heads 130 of the respective colors of CMYK. In addition, the skew corrector 213 inputs image data DATA of the respective colors of CMYK to the data transfer units 303 corresponding to the respective colors.

According to the timing of the LSYNC input from the signal generator 302, the light emission controller 304 outputs a strobe signal STRB for performing light emission control of the LEDA print head 130. The light emission controllers 304 are provided so as to correspond to the respective LEDA print heads 130 of the respective colors of CMYK. Thus, the signal generator 302 outputs LSYNCs generated for the respective colors of CMYK, to the light emission controllers 304 corresponding to the respective colors.

In the LEDA print head 130 of each color of CMYK, a light emission signal input unit 135 acquires the STRB input from the light emission controller 304, and inputs the acquired STRB to the driving circuits 133 corresponding to the respective LEDAs 132.

A data signal DATA input from the data transfer unit 303 is acquired by an image data input unit 134 in the LEDA print head 130, and input to the driving circuits 133 corresponding to the respective LEDAs 132. The image data input unit 134 develops the data signal DATA input as serial data, into parallel data. Thus, the image data input unit 134 includes, for example, a shift register.

Based on the DATA input from the image data input unit 134, the driving circuits 133 switch the lighted/unlighted state of a plurality of LED elements included in the LEDAs 132, and drive the LEDAs 132 to emit light, according to the strobe signal STRB input from the light emission signal input unit 135.

In the discharge process, the data signal DATA of the image data corresponding to the lighting control for the discharge process that has been generated by the image processor 212 as described above is transferred from the data transfer unit 303 to the image data input unit 134. The data is input from the image data input unit 134 to the driving circuits 133, and the light emission controller 304 outputs the STRB based on the LSYNC adjusted according to the setting performed in the register 301. Through the process, the lighting states as illustrated in FIGS. 26 and 28 are realized.

Figure 33:
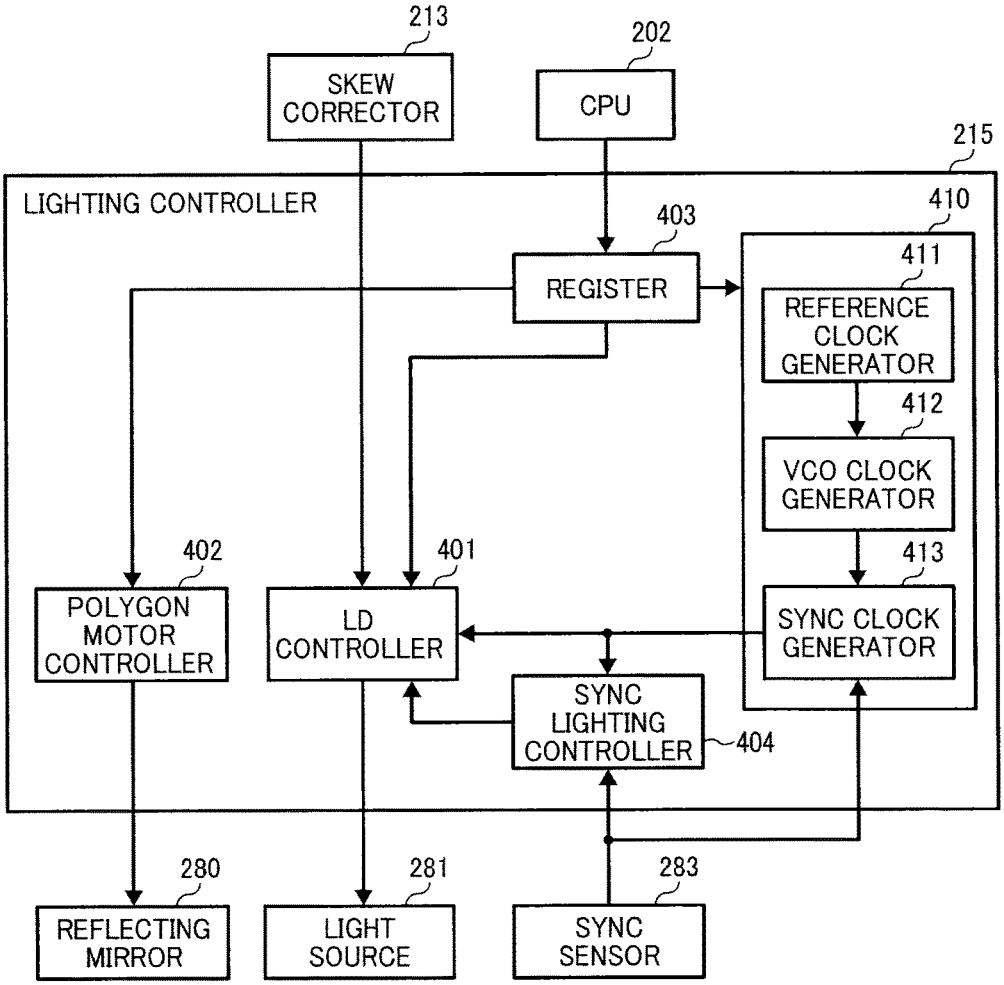
FIG. 33 is a diagram illustrating a functional configuration of an LD controller according to the embodiment.

FIG. 33 is a block diagram illustrating a functional configuration of the lighting controller 215 corresponding to a rotating reflection light source, and a connection relationship with each component included in the rotating reflection light source, such as the LD light source 281. As illustrated in FIG. 32, the lighting controller 215 corresponding to the rotating reflection light source includes an LD controller 401, a polygonal motor controller 402, a register 403, a synchronization detection lighting controller 404, and a pixel clock generator 410.

According to a pixel clock input from the pixel clock generator 410, the LD controller 401 performs lighting control of the LD light source 281 based on pixel data input from the skew corrector 213. The polygonal motor controller 402 controls the reflecting mirror 280 to rotate. The LD controller 401 and the polygonal motor controller 402 each perform the above-described control according to the setting values written by the CPU 202 in the register 403.

The synchronization detection lighting controller 404 inputs a lighting signal to the LD controller 401 for forcibly turning on the LD light source 281 at a timing when a laser beam reflected by the reflecting mirror 280 enters the horizontal synchronization detection sensor 283. At first, the synchronization detection lighting controller 404 forcibly turns on the LD controller 401 to acquire a signal from the horizontal synchronization detection sensor 283, thereby identifying the cycle of a horizontal synchronization detection signal from the horizontal synchronization detection sensor 283. Thereafter, the synchronization detection lighting controller 404 inputs a lighting signal to the LD controller 401 according to the cycle of the horizontal synchronization detection signal that has been identified in this manner.

The pixel clock generator 410 includes a reference clock generator 411, a voltage controlled oscillator (VCO) clock generator 412, and a phase synchronization clock generator 413. In addition, using these functions, the pixel clock generator 410 generates a pixel clock for the LD controller 401 performing lighting control corresponding to each pixel on one main scanning line.

The reference clock generator 411 generates and outputs a reference clock based on the setting value written by the CPU 202 in the register 403. The VCO clock generator 412 generates and outputs a VCO clock based on the reference clock. The phase synchronization clock generator 413 synchronizes the VCO clock with a horizontal synchronization signal input from the horizontal synchronization detection sensor 283, and outputs the resultant clock as a pixel clock.

In such a configuration, in either odd-numbered main scanning lines or even-numbered main scanning lines, the LD controller 401 does not turn on the LD light sources 281 irrespective of pixel data input from the skew corrector 213, as described with reference to FIG. 16. As a result, the resolution in the sub-scanning direction is controlled to be half of the original resolution.

In addition, an adjustment amount of the resolution in the sub-scanning direction in the case of using the rotating reflection light source is not limited to the above-described mode of turning off either odd-numbered main scanning lines or even-numbered main scanning lines, i.e., the mode of halving the resolution. For example, in the case of turning on only one line in three lines, the resolution in the sub-scanning direction can be controlled to be one-third.

In the case of using the rotating reflection light source in this manner, by setting, in the register 403, a frequency of lighting up the LD light sources 281 for each main scanning line, the lighting controller 215 can control the resolution in the sub-scanning direction to be one-integer-th of the original resolution.

Figure 34:
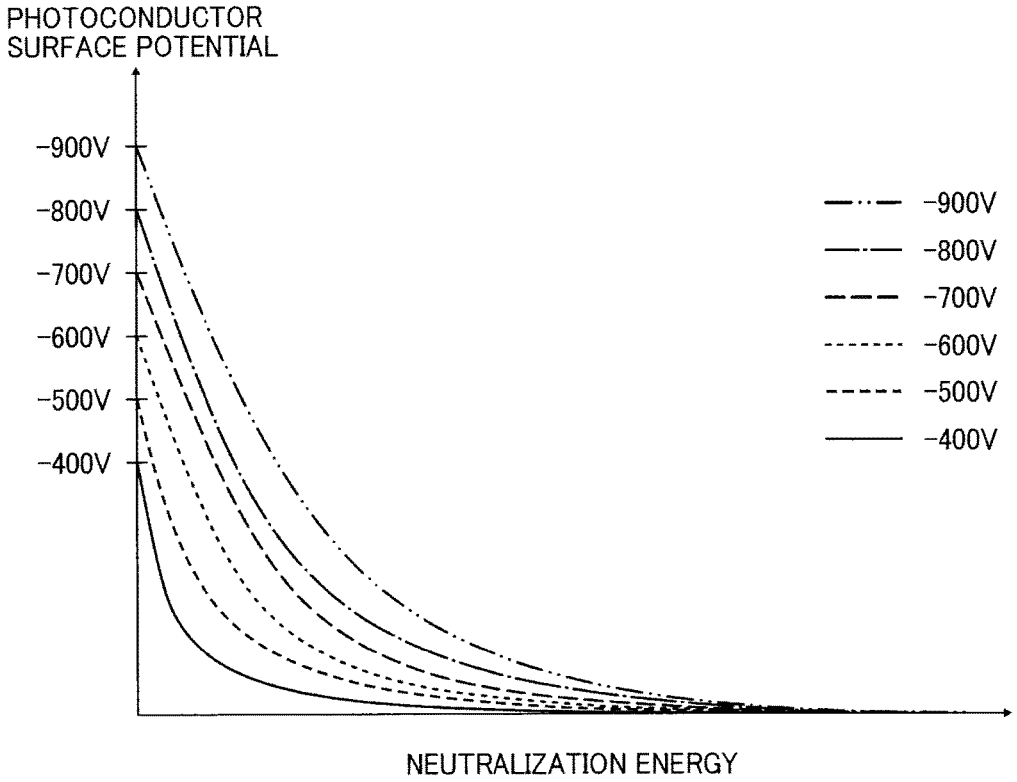
FIG. 34 is a diagram illustrating a relationship between a charging electric charge and a discharge energy according to the embodiment of the present invention.

FIG. 34 is a diagram illustrating an exposure energy required according to the voltage of a charging bias that is applied to the photoconductor drum 109 by the charging device 110, i.e., a discharge energy $E_0$. FIG. 34 illustrates a relationship between a photoconductor surface potential and an exposure energy in each of the cases in which charging biases are −400 V to −900 V.

As illustrated in FIG. 34, the discharge energy $E_0$ varies according to a charging bias. The larger the absolute value of the discharge energy $E_0$ is, the higher required exposure energy is. As illustrated in FIGS. 25, 27, and 29, the lowest value among exposure energies corresponding to positions on the photoconductor becomes lower as the resolution in the sub-scanning direction is lower.

Thus, based on a charging bias applied to the photoconductor drum 109 by the charging device 110, the CPU 202 calculates such a resolution in the sub-scanning direction that the discharge energy $E_0$ is satisfied on the entire surface of the photoconductor drum 109. Then, based on the calculation result, the CPU 202 sets the resolution in the sub-scanning direction, in the register 301 or 403 of the lighting controller 215.

In the above-described calculation of the resolution in the sub-scanning direction, as illustrated in FIG. 34, besides the discharge energy $E_0$ defined based on a charging bias eb, parameters affecting an exposure energy are considered.

Examples of the parameters include a linear speed v corresponding to a rotating speed of the photoconductor drum 109, a developing bias Db, a light emission time t of each pixel, a temperature T, a humidity h, and the like. In other words, the CPU 202 obtains a resolution R in the sub-scanning direction by a calculation formula using the above-described parameter values, as illustrated in the following Formula (1): $R=f(E_0, v, Db, t, T, h)$.

The CPU 202 then sets the resolution R in the sub-scanning direction that has been obtained by the above-described Formula (1), in the register 301 or 403. As a result, the resolution in the sub-scanning direction in the discharge process is changed by the function described with reference to FIGS. 32 and 33.

As described above, in an image forming apparatus equipped with an optical writing device, the optical writing device executes exposure for discharging, and a resolution adjusted to be lower than that in a normal print process is set as a resolution in the sub-scanning direction in the discharge process. The resolution adjusted to be lower is set so that the discharge energy $E_0$ can be obtained on the entire surface of the photoconductor drum 109, considering that the discharge energy $E_0$ is satisfied by the superimposition of exposure energies obtained by different pixels as described with reference to FIG. 15.

With this configuration, the amount of consumed power can be reduced while keeping an exposure energy required for discharging. The present invention is applicable to any of the case of using a linear light source and the case of using a rotating reflection light source as described above, as long as such control can be performed. Thus, the reduction in the amount of power consumed in the case of performing a discharge process of a photoconductor using an optical writing device for forming an electrostatic latent image can be achieved irrespective of the type of a light source device.

In addition, at the end of each print job, a discharge process is executed while maintaining the rotating speed of the photoconductor drum 109. Thus, the downtime of an apparatus that is caused by the discharge process can be minimized while maintaining a discharge effect.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

The invention claimed is:

1. An optical writing control device comprising:

circuitry configured to control emission of a light source onto a photoconductor surface in a latent image forming process and a discharge process, the light source including a plurality of linearly-arranged light emission elements, wherein, in the latent image forming process, the circuitry causes the light source to emit the light based on image data input to the circuitry to form an electrostatic latent image on the photoconductor surface, wherein, in the discharge process, the circuitry causes the light source to emit the light while turning off a part of the plurality of light emission elements to discharge the photoconductor surface, and extends a strobe signal interval during which the light emission of the light source is driven, and wherein a light emission time of one light emission control in the discharge process is set longer than a light emission time of one light emission control in the latent image forming process.

2. The optical writing control device according to claim 1, wherein, in the discharge process, the circuitry turns off the part of the plurality of light emission elements such that an interval between the adjacent light emission elements that are turned off is equal.

3. The optical writing control device according to claim 2, wherein, in the discharge process, the circuitry alternately controls the light emission of the plurality of light emission elements of the light source.

4. An image forming apparatus comprising the optical writing control device according to claim 1.

5. A method of controlling emission of a light source including a plurality of linearly-arranged light emission elements, performed by an optical writing control device, the method comprising:

in a latent image forming process, causing, with circuitry, the light source to emit a light based on image data input to the circuitry to form an electrostatic latent image on a photoconductor surface; and in a discharge process, causing, with the circuitry, the light source to emit a light while turning off a part of the plurality of light emission elements to discharge the photoconductor surface, and extending, with the circuitry, a strobe signal interval during which the light emission of the light source is driven, wherein a light emission time of one light emission control in the discharge process is set longer than a light emission time of one light emission control in the latent image forming process.

6. An optical writing control device comprising:

circuitry configured to control lighting of a light source onto a photoconductor surface in latent image forming process and a discharge process, wherein, in the latent image forming process, the circuitry causes the light source to emit the light based on image data input to the circuitry to form an electrostatic latent image on the photoconductor surface, wherein, in the discharge process, the circuitry causes the light source to emit the light to discharge the photoconductor surface, and extends a strobe signal interval during which the light emission of the light source is driven, and wherein a resolution in a sub-scanning direction in the discharge process is set lower than a resolution in a sub-scanning direction in the latent image forming process.

7. The optical writing control device according to claim 6, wherein the resolution in a sub-scanning direction in the discharge process is previously determined based on an exposure energy required for discharging the entire photoconductor surface.

8. The optical writing control device according to claim 7, wherein the exposure energy required for discharging the entire photoconductor surface is obtained by superimposing exposure energies corresponding to different main scanning lines.

9. The optical writing control device according to claim 6, wherein the light source is a rotating reflection light source that irradiates a rotating reflection mirror with laser beams, and wherein the circuitry thins out main scanning lines to be irradiated with the laser beams to control the resolution in the sub-scanning direction in the discharge process.

10. An image forming apparatus comprising the optical writing control device according to claim 6.

* * * * *